US012527441B1

(12) United States Patent
Chen et al.

(10) Patent No.: US 12,527,441 B1
(45) **Date of Patent: *Jan. 20, 2026**

(54) FOLDING BATHTUB

(71) Applicant: Taizhou Xiaotanglang Infant and Child Products Co., Ltd., Taizhou (CN)

(72) Inventors: Jian Chen, Taizhou (CN); Tao Yang, Taizhou (CN)

(73) Assignee: Taizhou Xiaotanglang Infant and Child Products Co., Ltd., Taizhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 19/194,333

(22) Filed: Apr. 30, 2025

Related U.S. Application Data

(63) Continuation-in-part of application No. 19/076,424, filed on Mar. 11, 2025, and a continuation-in-part of application No. 18/918,773, filed on Oct. 17, 2024, now Pat. No. 12,290,215.

(51) Int. Cl.
*A47K 3/064* (2006.01)

(52) U.S. Cl.
CPC ..... *A47K 3/064* (2013.01)

(58) Field of Classification Search
CPC ..... A47K 3/064
USPC ..... 4/584
See application file for complete search history.

(56) References Cited

U.S. PATENT DOCUMENTS

| | | | | | |
|---|---|---|---|---|---|
| 243,573 | A * | 6/1881 | Jones | | |
| 2,718,642 | A * | 9/1955 | Kennedy | A47K 3/064 | 4/587 |
| 2,841,798 | A * | 7/1958 | Kennedy | A47K 3/064 | 4/586 |
| 3,799,228 | A * | 3/1974 | Crawford | A45F 4/00 | 4/538 |
| 12,290,215 | B1 * | 5/2025 | Chen | A47K 3/06 | |
| 2013/0198947 | A1 * | 8/2013 | Yeung | A47K 3/00 | 4/585 |
| 2020/0323396 | A1 * | 10/2020 | Mutch | A47K 3/064 | |
| 2022/0079390 | A1 * | 3/2022 | Pruzhansky | A47K 3/024 | |
| 2023/0146681 | A1 * | 5/2023 | Mu | A47K 3/062 | 4/584 |
| 2023/0159223 | A1 * | 5/2023 | Mu | B65D 7/26 | |
| 2023/0355008 | A1 * | 11/2023 | Mu | A47D 9/005 | |

* cited by examiner

*Primary Examiner* — Huyen D Le

(57) ABSTRACT

A folding bathtub includes a bathtub body and a supporting body. The supporting body is provided with a support frame and support legs, the support legs are connected with the support frame, and the support frame is supported by the support legs. The support frame is detachably connected with the bathtub body, and the bathtub body is supported by the support frame, so that the support frame can be connected with the bathtub body when the bathtub body needs to be used by a user, the bathtub body is supported by the support legs and the support frame, and the bathtub body is prevented from being deformed to be convenient for the user to use.

20 Claims, 16 Drawing Sheets

FOLDING BATHTUB

CROSS-REFERENCE TO RELATED APPLICATIONS

This application is a Continuation-in-Part of the U.S. application Ser. No. 19/076,424 filed on Mar. 11, 2025, and entitled "FOLDING BATHTUB" now pending which is a Continuation-in-Part of the U.S. application Ser. No. 18/918,773 filed on Oct. 17, 2024, the entire disclosures of which are incorporated herein by reference.

TECHNICAL FIELD

The present invention relates to the technical field of bathtubs, in particular to a folding bathtub.

BACKGROUND

As main equipment of the bathroom, the bathtub is usually used by people in a hip bath. However, for babies, since they cannot take a bath yet, the bathtub becomes necessary bathing equipment. Among all kinds of bathtubs, the folding bathtub is particularly preferred because of the advantages such as portability and small occupied area.

However, the support frame of the existing bathtub is not detachable, the support frame takes up a large space when the user stores the bathtub, so a lot of troubles and inconvenience are caused to the user.

SUMMARY

In order to overcome the shortcomings of the prior art, the present invention provides a folding bathtub.

A folding bathtub, includes:

a bathtub body; and a supporting body, wherein the supporting body is provided with a support frame and support legs, the support legs are connected with the support frame, and the support frame is supported by the support legs; and the support frame is detachably connected with the bathtub body, and the bathtub body is supported by the support frame.

As an improvement of the present invention, the bathtub body is provided with a body part and a supporting part extending out on the upper side of the body part, the supporting part is connected with the support frame, and the supporting part is supported by the support frame.

As an improvement of the present invention, a concave support ring slot is formed in the supporting part, and the support frame is arranged inside the support ring slot.

As an improvement of the present invention, the folding bathtub also includes a first locking device, and the support frame is detachably connected with the bathtub body through the first locking device.

As an improvement of the present invention, the first locking device includes a locking overturning buckle and a first locking portion, the first locking portion is arranged on the support frame, the locking overturning buckle is provided with a second locking portion, the locking overturning buckle is rotatably connected with the bathtub body, the locking overturing buckle can rotate between a locking position and an unlocking position, when the locking overturning buckle rotates to the locking position, the second locking portion is connected with the first locking portion, and the first locking portion is compressed towards the direction of the bathtub body by the second locking portion so that the support frame is compressed and locked to the bathtub body, and when the locking overturning buckle rotates to the unlocking position, the second locking portion is separated from the first locking portion so as to release the unlocking between the support frame and the bathtub body.

As an improvement of the present invention, the first locking device includes a locking overturning buckle and a first locking portion, the first locking portion is arranged on the bathtub body, the locking overturning buckle is provided with a second locking portion, the locking overturning buckle is rotatably connected with the support frame, the locking overturing buckle can rotate between a locking position and an unlocking position, when the locking overturning buckle rotates to the locking position, the second locking portion is connected with the first locking portion, and the first locking portion is compressed towards the direction of the bathtub body by the second locking portion so that the support frame is compressed and locked to the bathtub body, and when the locking overturning buckle rotates to the unlocking position, the second locking portion is separated from the first locking portion so as to release the unlocking between the support frame and the bathtub body.

As an improvement of the present invention, the first locking portion is a first locking bulge, and the second locking portion is a second locking bulge.

As an improvement of the present invention, the locking overturning buckle is provided with a first rotating shaft, the bathtub body is provided with two mounting lugs arranged at intervals mutually, a first mounting hole is formed in the mounting lug, the first rotating shaft is plugged and mounted in the first mounting hole, and the first rotating shaft can rotate inside the first mounting hole; and the number of the second locking portions is two, and the two second locking portions are arranged at intervals mutually along the transverse direction of the locking overturning buckle.

As an improvement of the present invention, the number of the first locking devices is two, the two first locking devices are respectively located on left and right sides of the bathtub body, and the support frame is compressed and locked to the bathtub body by the first locking device.

As an improvement of the present invention, the support frame includes a left support frame and a right support frame, and the left support frame is detachably connected with the right support frame.

As an improvement of the present invention, the left support frame is provided with a first end and a second end, the right support frame is provided with a third end and a fourth end, the first connecting device includes a first connecting piece and a second connecting piece, the first end is detachably connected with the third end through the first connecting piece, and the second end is detachably connected with the fourth end through the second connecting piece so that the left support frame and the right support frame are connected into a whole body.

As an improvement of the present invention, a first splicing groove is formed in the first end, a second splicing groove is formed in the third end, one end of the first connecting piece is provided with a first splicing lug, the other end of the first connecting piece is provided with a second splicing lug, the first splicing lug is detachably connected with the first splicing groove, and the second splicing lug is detachably connected with the second splicing groove; a third splicing groove is formed in the second end, a fourth splicing groove is formed in the fourth end, one end of the second connecting piece is provided with a third splicing lug, the other end of the second connecting piece is provided with a fourth splicing lug, the third splicing lug is detachably connected with the third splicing groove, and the fourth splicing lug is detachably connected with the fourth splicing groove so that the left support frame and the right support frame are connected into a whole body; or, the first end is provided with a first splicing lug, the third end is provided with a second splicing lug, a first splicing groove is formed in one end of the first connecting piece, a second splicing groove is formed in the other end of the first connecting piece, the first splicing lug is detachably connected with the first splicing groove, and the second splicing lug is detachably connected with the second splicing groove; the second end is provided with a third splicing lug, the fourth end is provided with a fourth splicing lug, a third splicing groove is formed in one end of the second connecting piece, a fourth splicing groove is formed in the other end of the second connecting piece, the third splicing lug is detachably connected with the third splicing groove, and the fourth splicing lug is detachably connected with the fourth splicing groove so that the left support frame and the right support frame are connected into a whole body.

As an improvement of the present invention, a first plug-in mounting port is formed in an inner wall of the first splicing groove, a second plug-in mounting port is formed in an inner wall of the second splicing groove, a third plug-in mounting port is formed in an inner wall of the third splicing groove, a fourth plug-in mounting port is formed in an inner wall of the fourth splicing groove, a protruding first plug-in mounting block is extended on a side wall of the first splicing lug, a protruding second plug-in mounting block is extended on a side wall of the second splicing lug, a protruding third plug-in mounting block is extended on a side wall of the third splicing lug, a protruding fourth plug-in mounting block is extended on a side wall of the fourth splicing lug, the first plug-in mounting block is connected with the first plug-in mounting port, the second plug-in mounting block is connected with the second plug-in mounting port, the third plug-in mounting block is connected with the third plug-in mounting port, and the fourth plug-in mounting block is connected with the fourth plug-in mounting port; or, the protruding first plug-in mounting block is extended on the inner wall of the first splicing groove, the protruding second plug-in mounting bloc is extended on the inner wall of the second splicing groove, the protruding third plug-in mounting block is extended on the inner wall of the third splicing groove, the protruding fourth plug-in mounting block is extended on the inner wall of the fourth splicing groove, the first plug-in mounting port is formed in the side wall of the first splicing lug, the second plug-in mounting port is formed in the side wall of the second splicing lug, the third plug-in mounting port is formed in the side wall of the third splicing lug, the fourth plug-in mounting port is formed in the side wall of the fourth splicing lug, the first plug-in mounting block is connected with the first plug-in mounting port, the second plug-in mounting block is connected with the second plug-in mounting port, the third plug-in mounting block is connected with the third plug-in mounting port, and the fourth plug-in mounting block is connected with the fourth plug-in mounting port.

As an improvement of the present invention, the support legs are removably connected with the support frame, and the support legs can move between a folding position and a supporting position.

As an improvement of the present invention, the support frame is provided with a protruding mounting part, the support legs are rotatably connected with the mounting part of the support frame, the support legs can rotate between the folding position and the supporting position, a supporting lug is extended on the side wall of the support leg, and when the support leg rotates to the supporting position, a bottom surface of the mounting part is supported by the supporting lug; and when the support leg rotates to the folding position, the support leg and the support frame are stacked mutually.

As an improvement of the present invention, the number of the support legs is two, and the two support legs are rotatably connected with both sides of the support frame respectively; and the support frame is a ring-shaped support frame, and the supporting part is a ring-shaped supporting part.

As an improvement of the present invention, the bathtub body includes an upper side wall part, a bottom part and a middle connecting wall part for connecting the upper side wall part and the bottom part, and the upper side wall part, the bottom part and the middle connecting wall part are surrounded to form a first accommodating cavity for accommodating liquid; the upper side wall part includes a first left side part and a first right side part, the middle connecting wall part includes a middle side wall part, the upper side of the middle side wall part is convexly provided with an upper connecting part, the upper connecting part is located between the first left side part and the first right side part, and the upper connecting part is used for connecting the first left side part and the first right side part; a bottom connecting part is extended on the lower side of the middle side wall part, the bottom part includes a first bottom and a second bottom, the bottom connecting part is located between the first bottom and the second bottom, and the bottom connecting part is used for connecting the first bottom and the second bottom; the bottom connecting part is a flexible bottom connecting part so as to be foldable between the first bottom and the second bottom, the upper connecting part is a flexible upper connecting part so as to be foldable between the first left side part and the first right side part, and the middle side wall part is a flexible middle side wall part so as to be foldable between the upper side wall part and the bottom part.

As an improvement of the present invention, a water outlet is formed in the bottom of the bathtub body, and the water outlet is detachably covered with the sealing plug; the sealing plug is provided with a covering part, a plug-in mounting part extending out of the covering part and a stop ring, the water outlet is covered with the covering part, the plug-in mounting part is plugged in and mounted inside the water outlet, the plug-in mounting part penetrates into a lower surface of the bottom of the bathtub body through the water outlet from an upper surface of the bottom of the bathtub body, the stop ring detachably sleeves the plug-in mounting part, and the stop ring is used for stopping the covering part and the plug-in mounting part inside the water outlet.

As an improvement of the present invention, hollowed-out grooves are formed in the support frame and the support legs, and the hollowed-out groove is internally provided with a plurality of reinforcing ribs; the support leg includes a bottom supporting portion and two side supporting portions, the two side supporting portions are connected to both ends of the bottom supporting portion respectively, and the side supporting portion is connected with the support frame.

As an improvement of the present invention, the middle connecting wall part is a flexible silicone middle connecting wall part, the upper side wall part is a rigid upper side wall part, and the bottom wall part is a rigid bottom wall part.

As an improvement of the present invention, a protruding first support ring is extended on the bottom surface of the first bottom, a protruding second support ring is extended on the bottom surface of the second bottom, and a protruding third support ring is extended on the bottom surface of the bottom connecting part. The number of the third support rings is two to eight, and the two to weight third support rings are arranged at intervals mutually along the bottom surface of the bottom connecting part. The water outlet is formed in the second bottom, and the water outlet is located inside the second support ring. Both the first support ring and the second support ring are square in shapes, and the third support rings are all circular.

As an improvement of the present invention, a plurality of sheet-shaped supporting bulges are extended on the upper side of the support frame, and the supporting bulges are arranged at intervals mutually along the upper side of the support frame.

As an improvement of the present invention, a sealing groove is formed in the side wall of the stop ring, and the edge of the water outlet is embedded in the sealing groove.

As an improvement of the present invention, the first plug-in mounting block, the second plug-in mounting block, the third plug-in mounting block and the fourth plug-in mounting block are all provided with a guide inclined surface. The first splicing lug can be detached from the first splicing groove along the guide inclined surface. The second splicing lug can be detached from the second splicing groove along the guide inclined surface. The third splicing lug can be detached from the third splicing groove along the guide inclined surface. The fourth splicing lug can be detached from the fourth splicing groove along the guide inclined surface.

The present invention has the beneficial effects: The present invention provides a folding bathtub includes a bathtub body and a supporting body. The supporting body is provided with a support frame and support legs, the support legs are connected with the support frame, and the support frame is supported by the support legs. The support frame is detachably connected with the bathtub body, and the bathtub body is supported by the support frame, so that the support frame can be connected with the bathtub body when the bathtub body needs to be used by a user, the bathtub body is supported by the support legs and the support frame, and the bathtub body is prevented from being deformed to be convenient for the user to use. When the user needs to store, package, and transport the folding bathtub, the support frame and the support legs can be detached from the bathtub body, so that the bathtub body, the support frame, and the support legs can be stacked mutually so as to reduce the volume of the folding bathtub and facilitate the storage, package, and transportation of the bathtub body, the support frame, and the support legs.

BRIEF DESCRIPTION OF THE DRAWINGS

In order to explain the technical solutions of the embodiments of the present invention more clearly, the following will briefly introduce the accompanying drawings used in the embodiments. The drawings in the following description are only some embodiments of the present invention. Those of ordinary skill in the art can obtain other drawings based on these drawings without creative work.

The present invention is further described below in detail in combination with the accompanying drawings and embodiments.

DETAILED DESCRIPTION OF THE EMBODIMENTS

Figure 1:
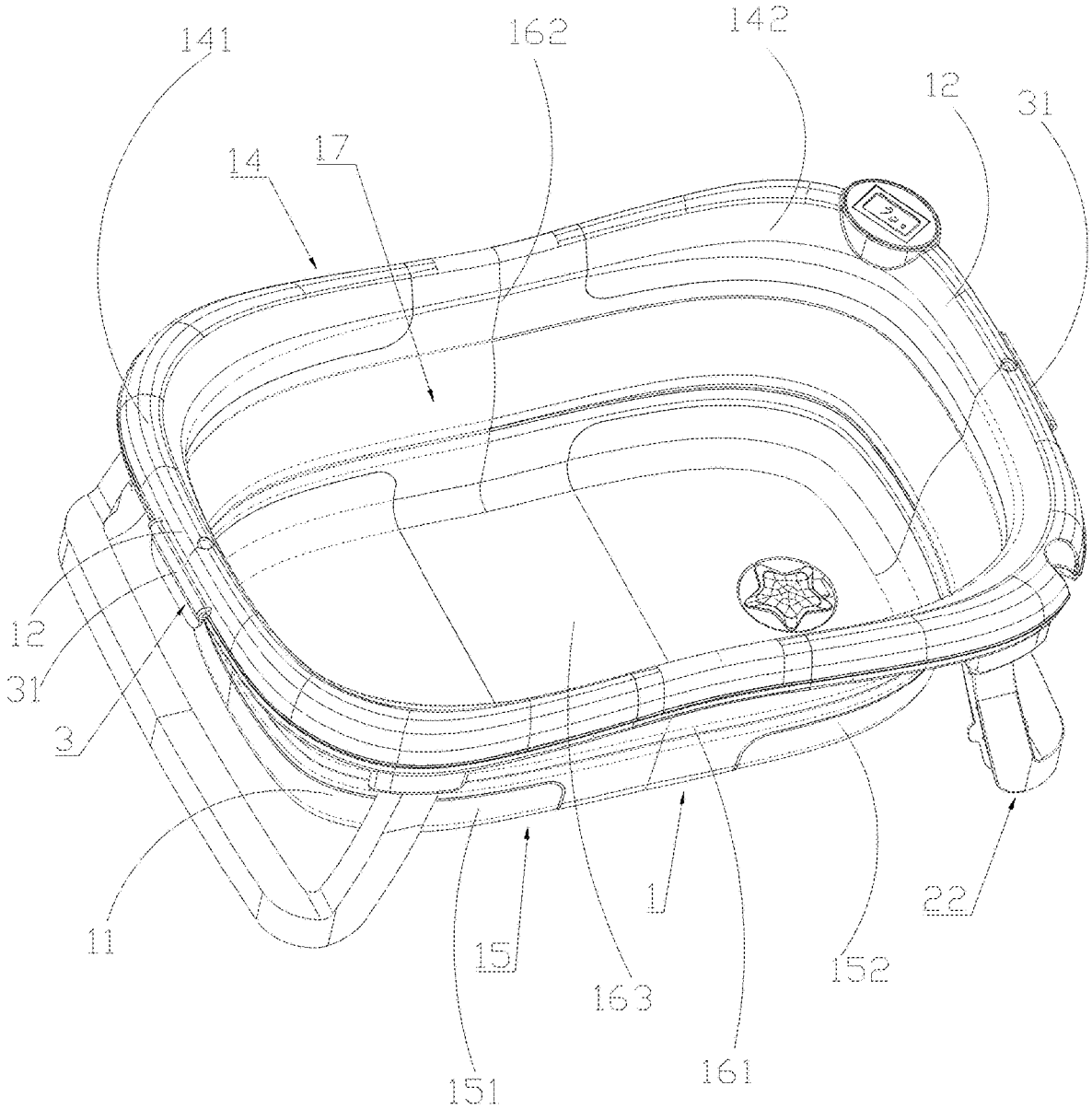
FIG. 1 is an integral structural schematic diagram of the present invention.
Figure 2:
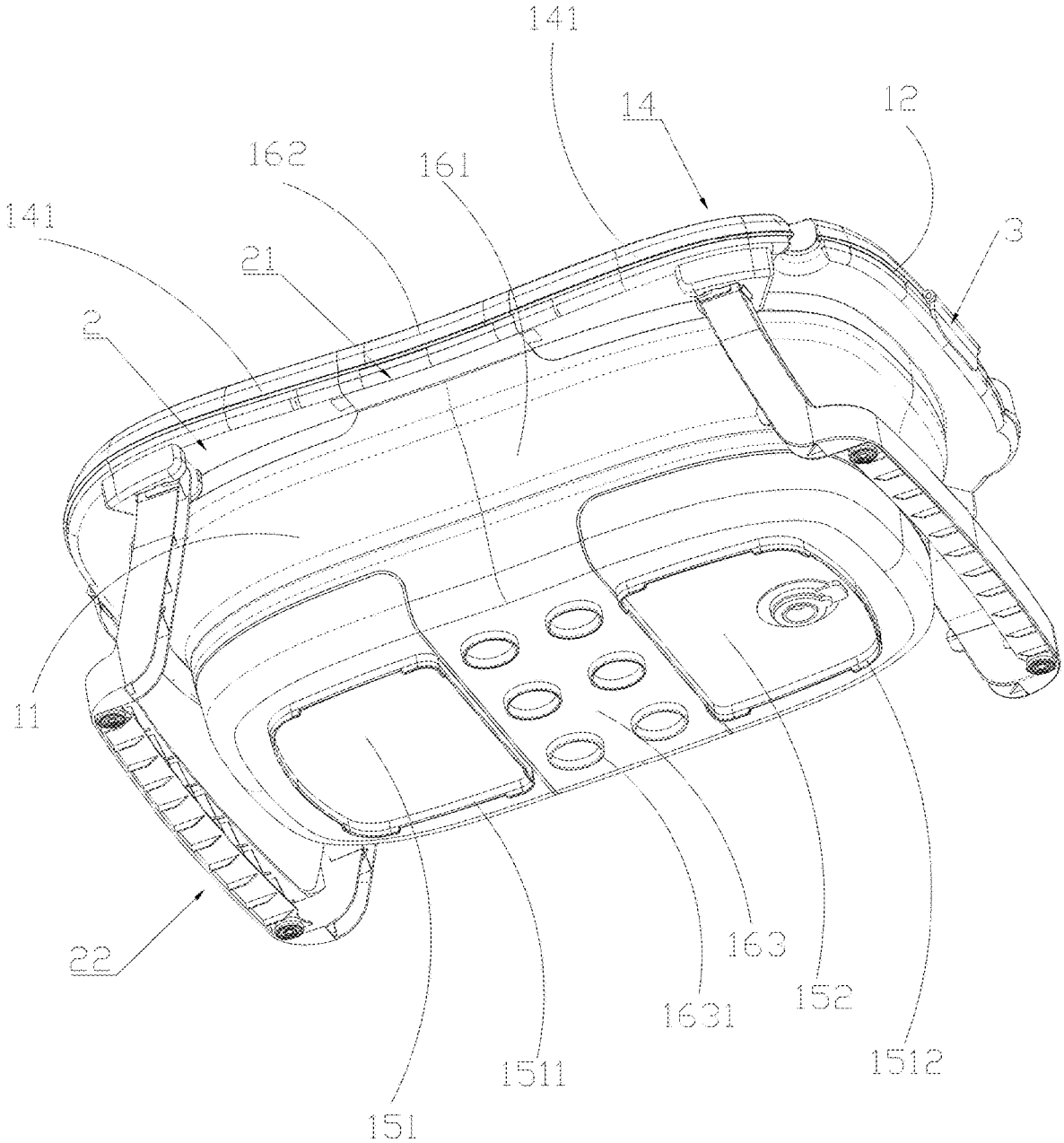
FIG. 2 is another integral structural schematic diagram of the present invention.
Figure 3:
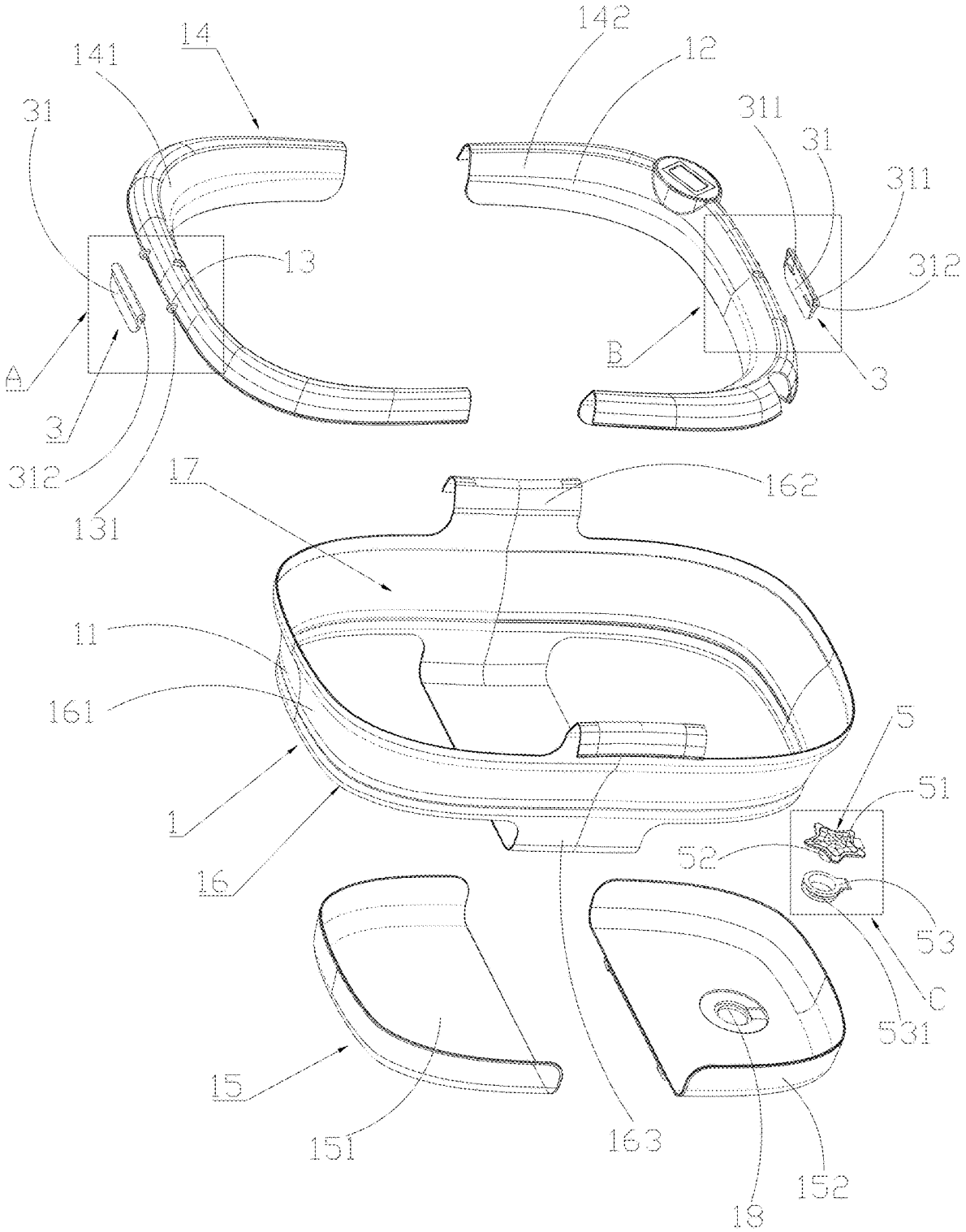
FIG. 3 is an explosive view of a bathtub body.
Figure 4:
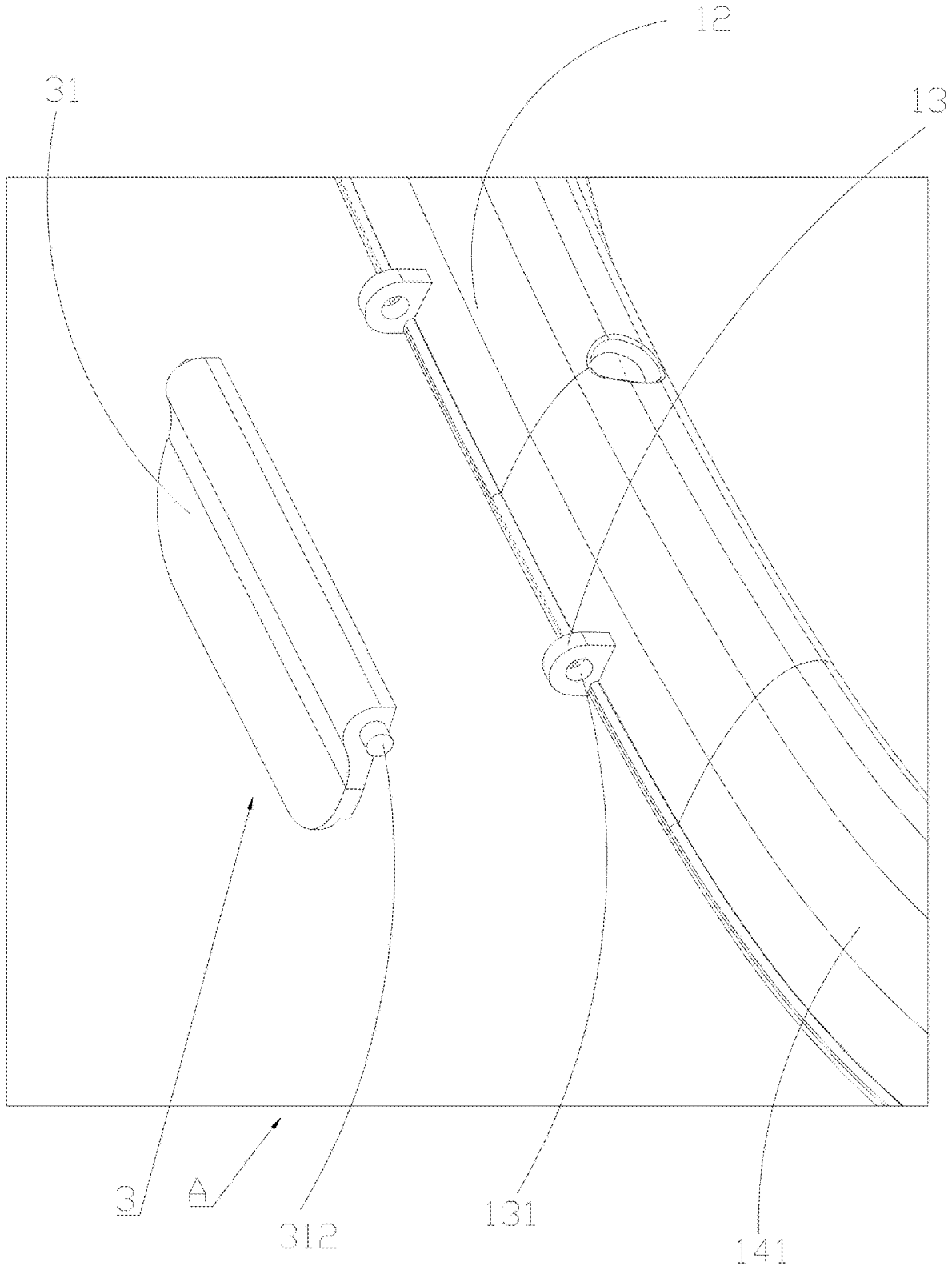
FIG. 4 is an enlarged view at the position of A in FIG. 3.
Figure 5:
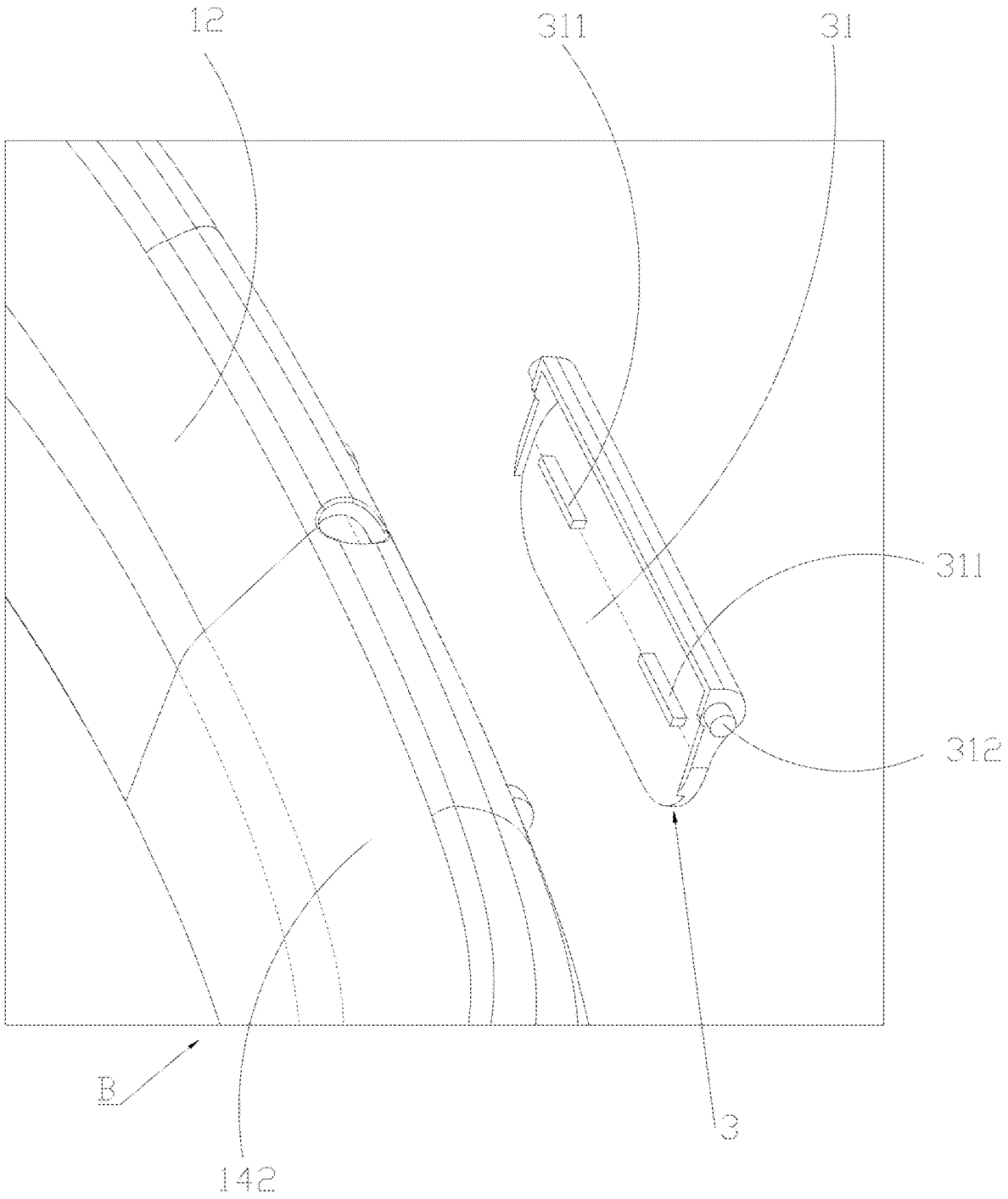
FIG. 5 is an enlarged view at the position of B in FIG. 3.
Figure 6:
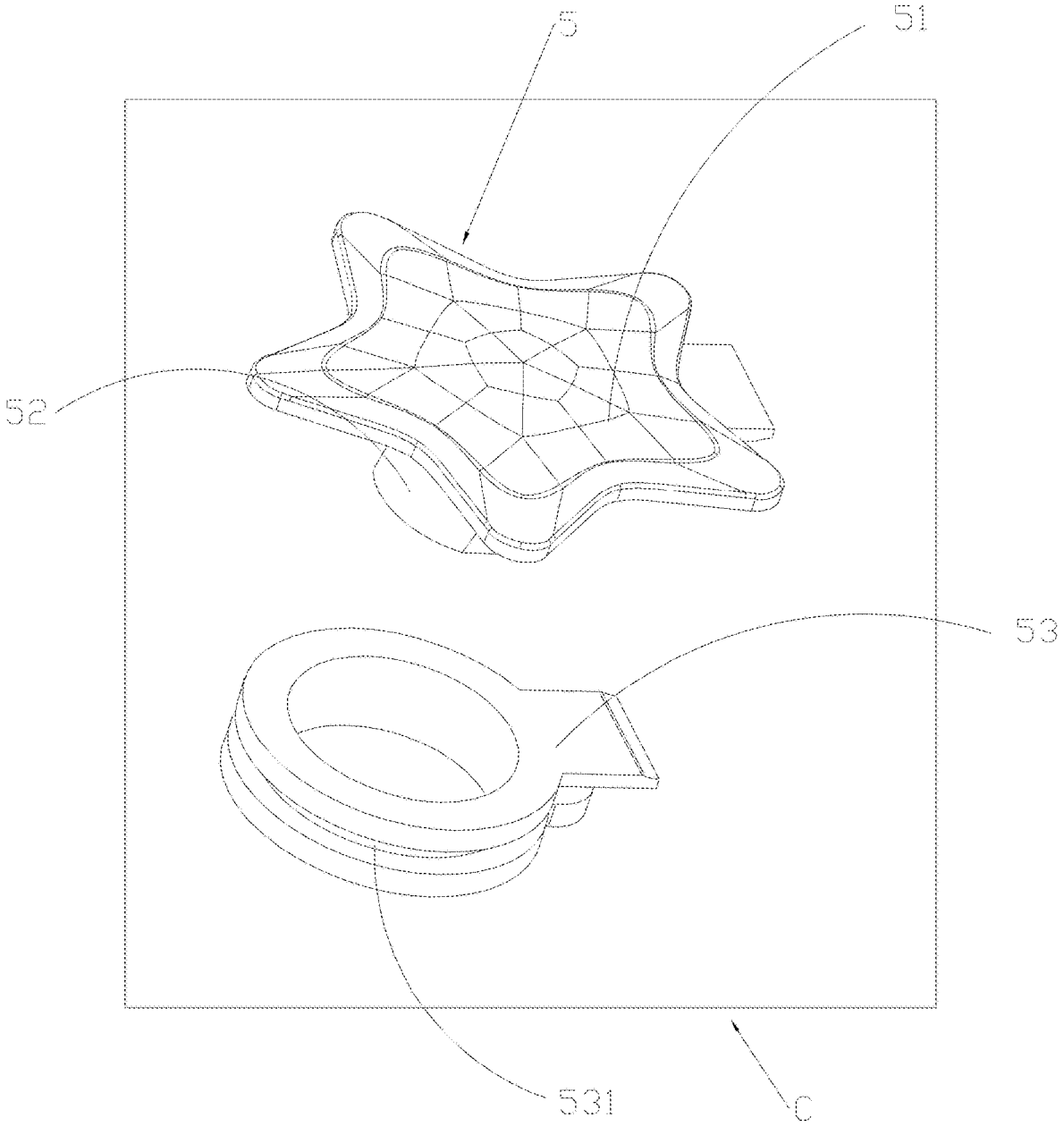
FIG. 6 is an enlarged view at the position of C in FIG. 3.
Figure 7:
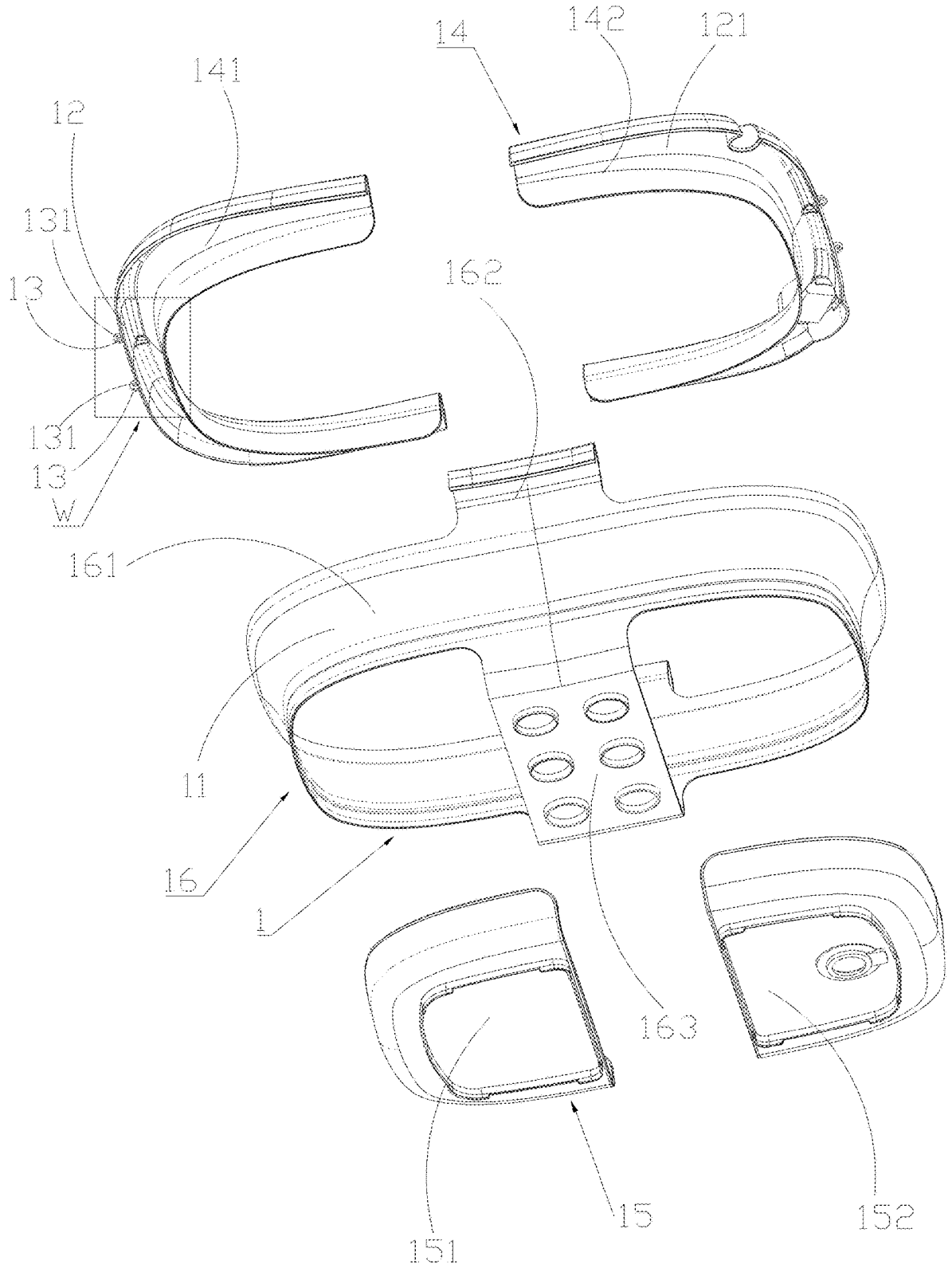
FIG. 7 is another explosive view of a bathtub body.
Figure 8:
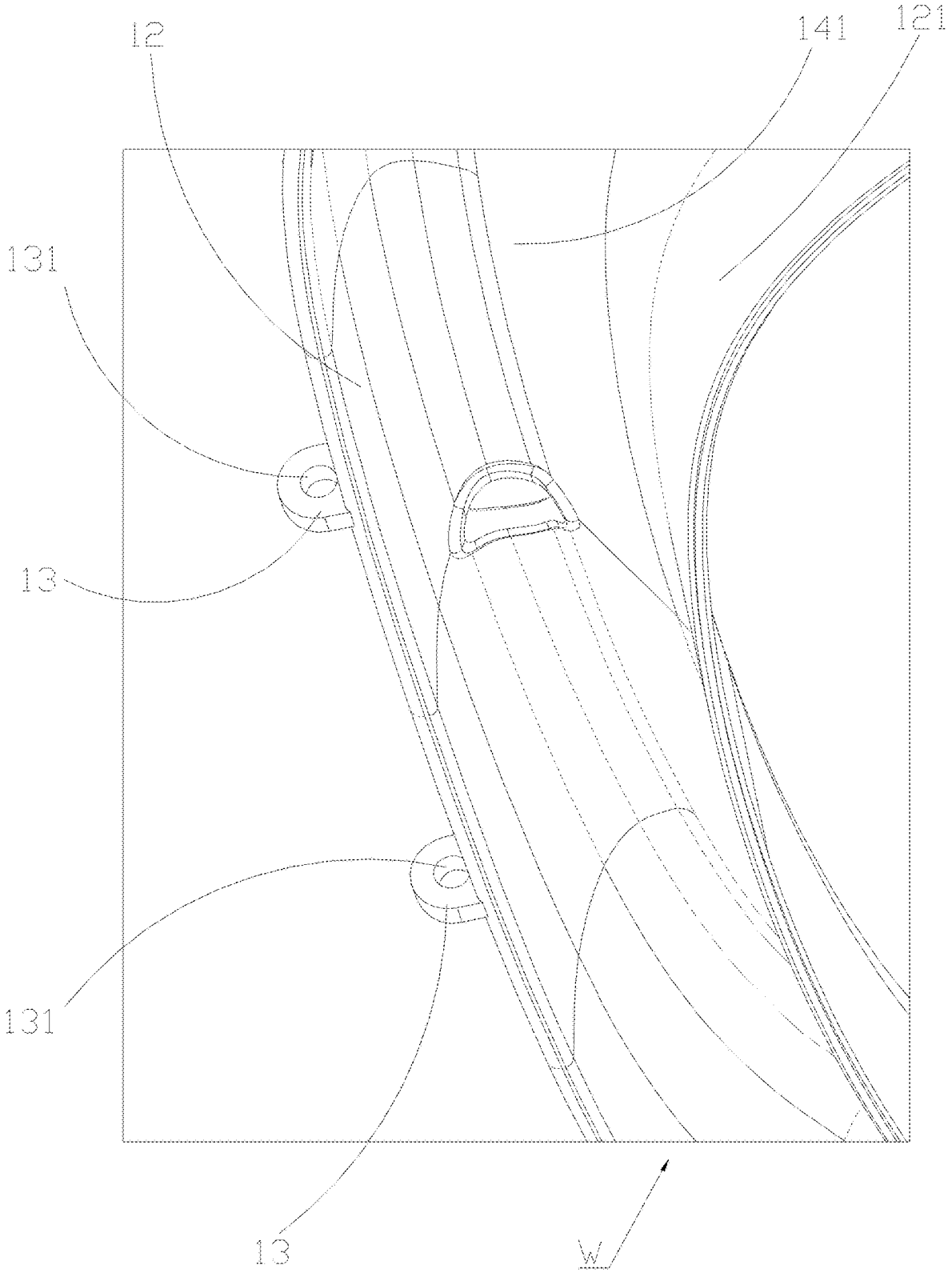
FIG. 8 an enlarged view at the position of W in FIG. 7.
Figure 9:
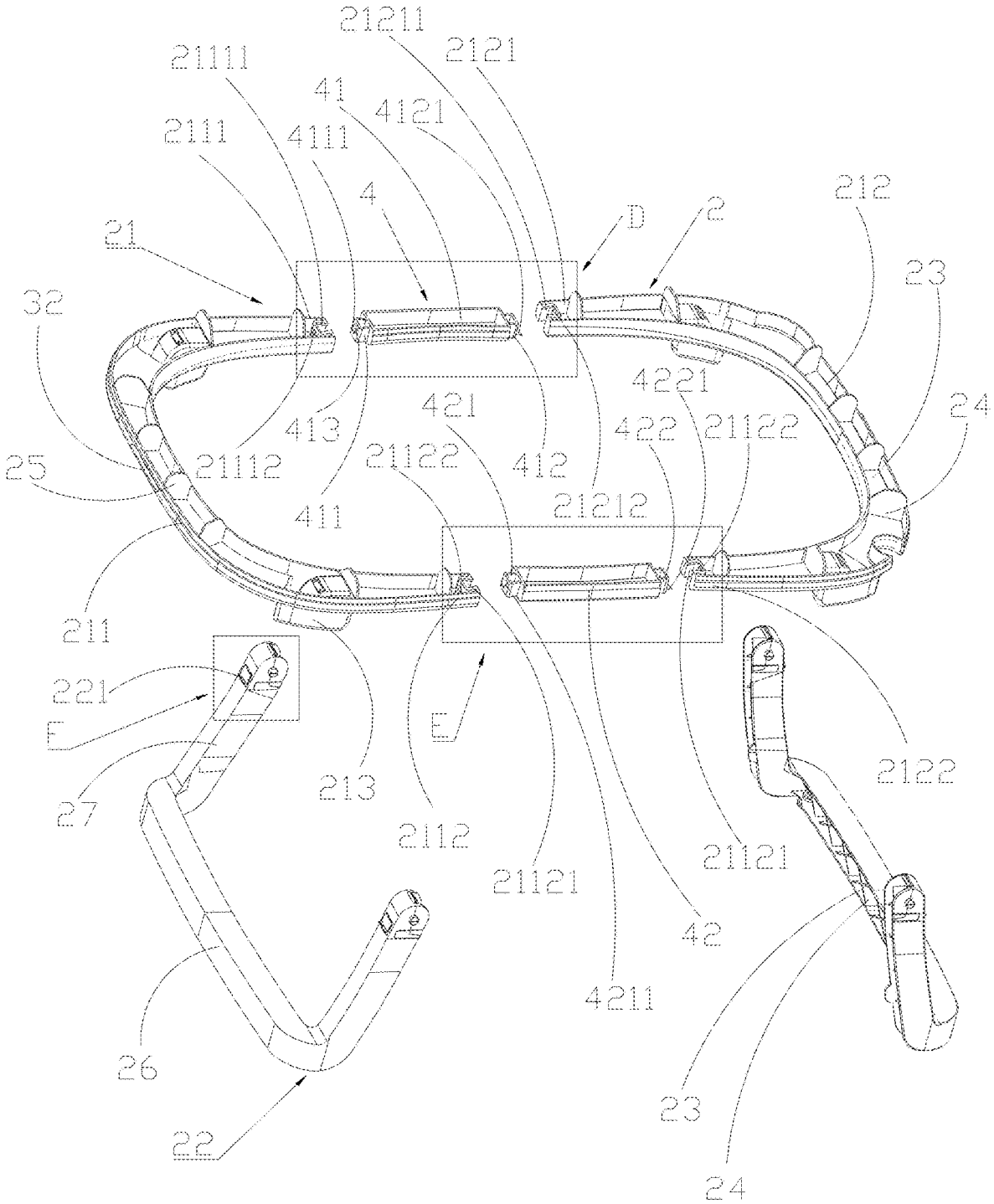
FIG. 9 is an explosive view of a supporting body.
Figure 10:
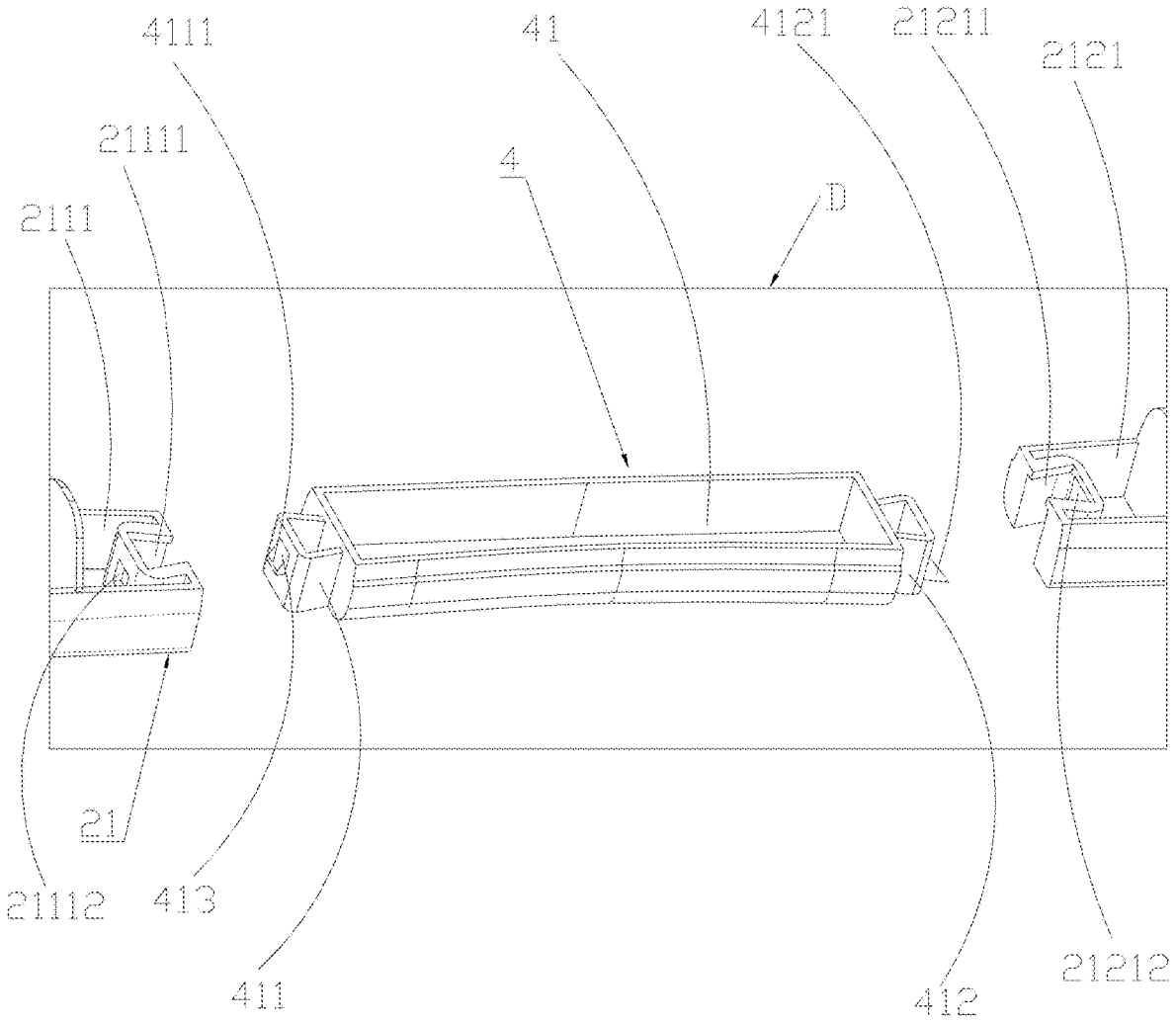
FIG. 10 is an enlarged view at the position of D in FIG. 9.
Figure 11:
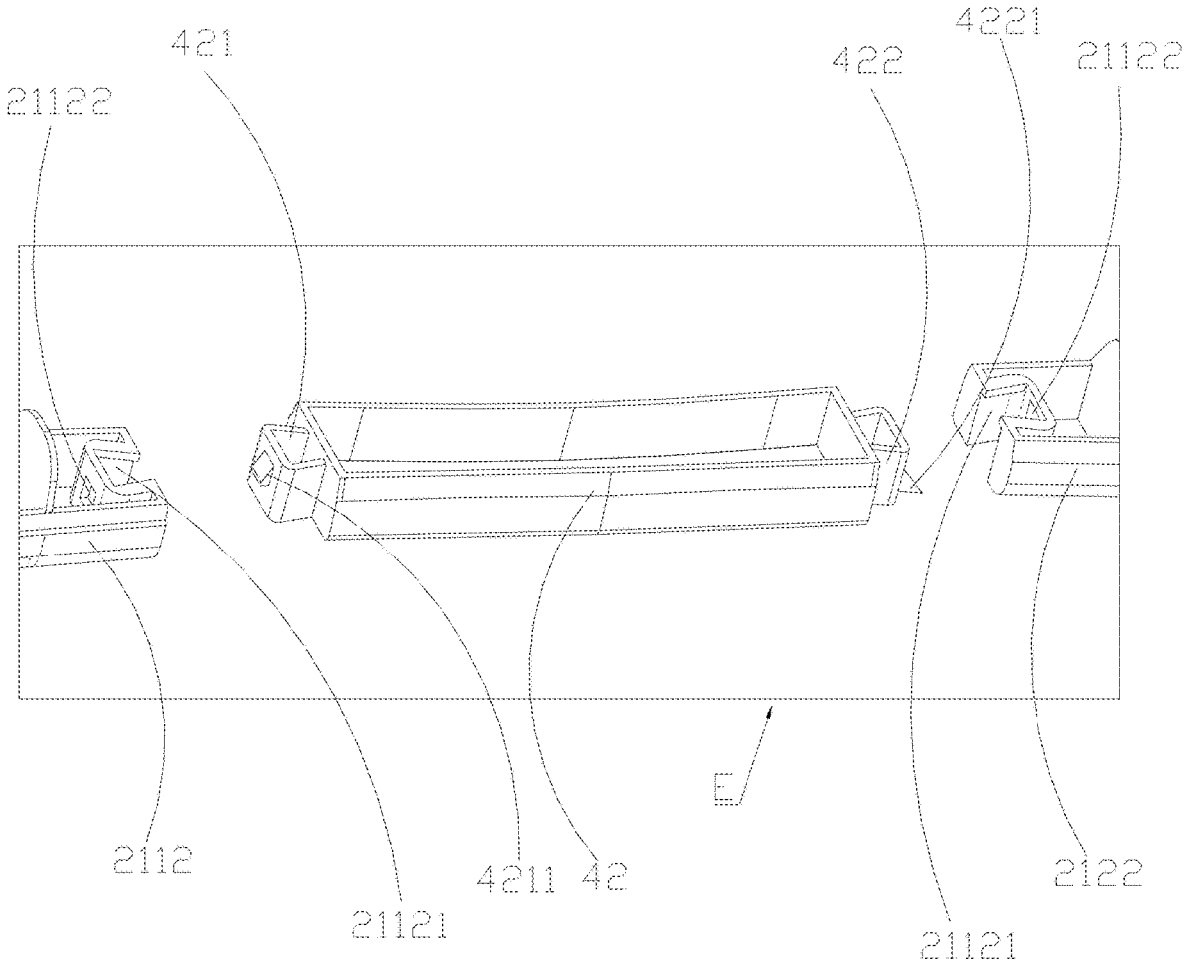
FIG. 11 is an enlarged view at the position of E in FIG. 9.
Figure 12:
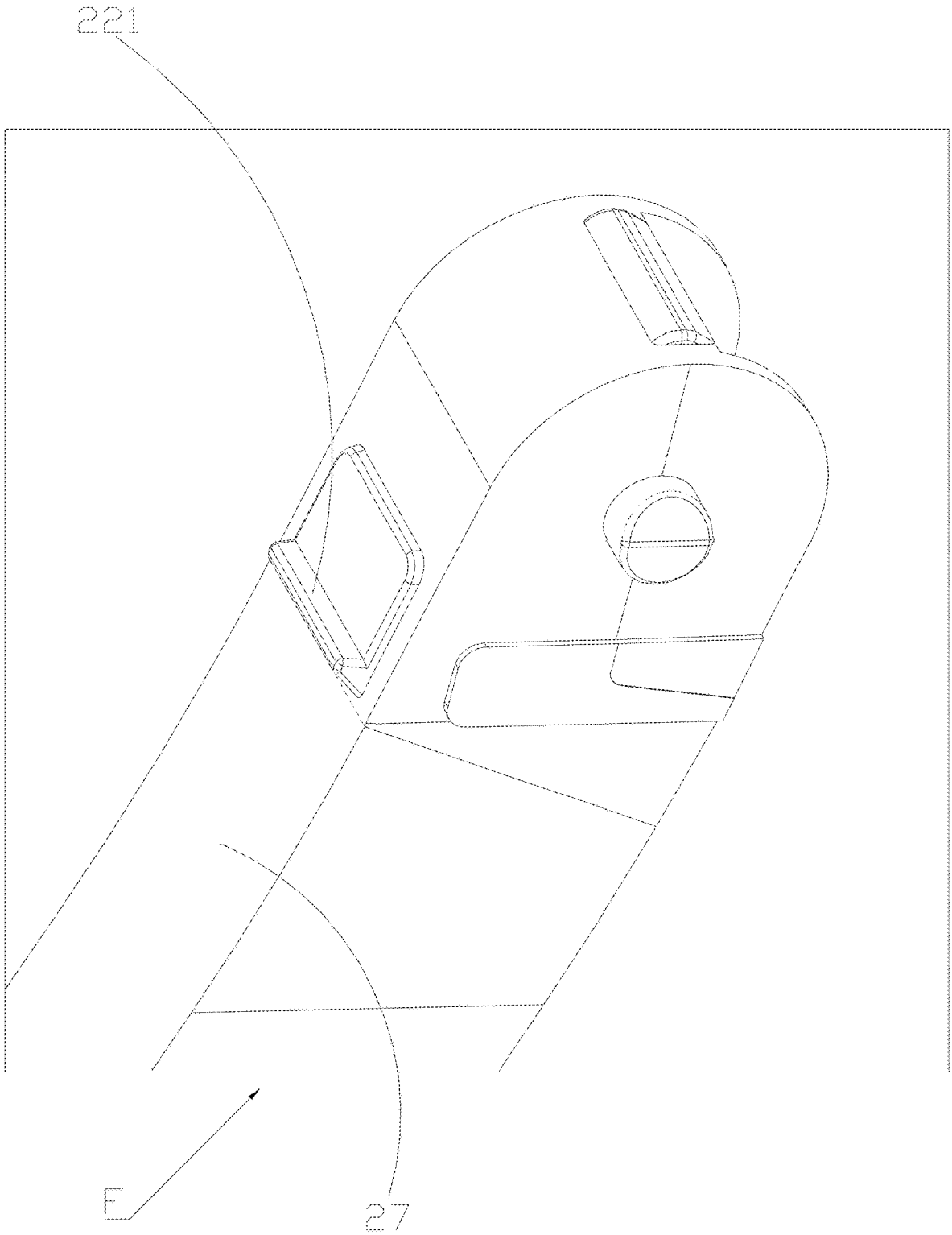
FIG. 12 is an enlarged view at the position of F in FIG. 9.
Figure 13:
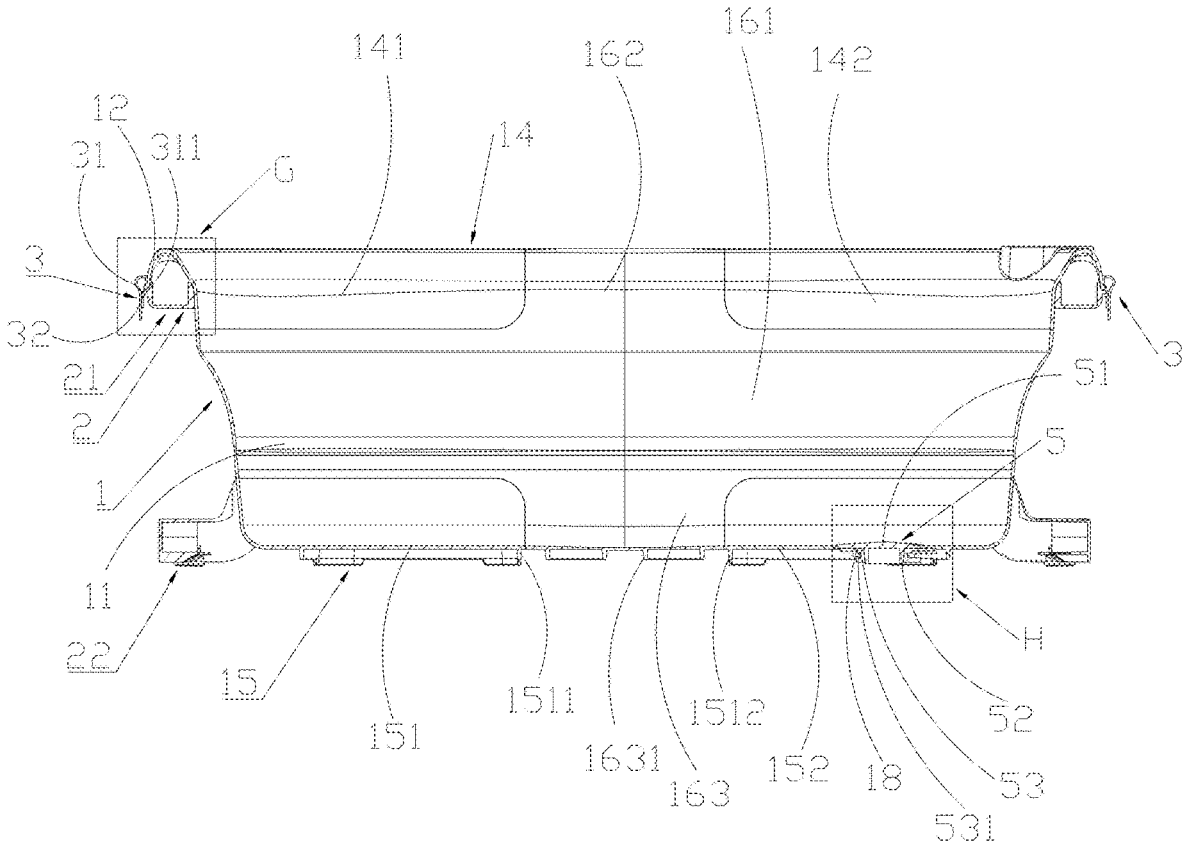
FIG. 13 is a sectioning section view along a bathtub body and a supporting body.
Figure 14:
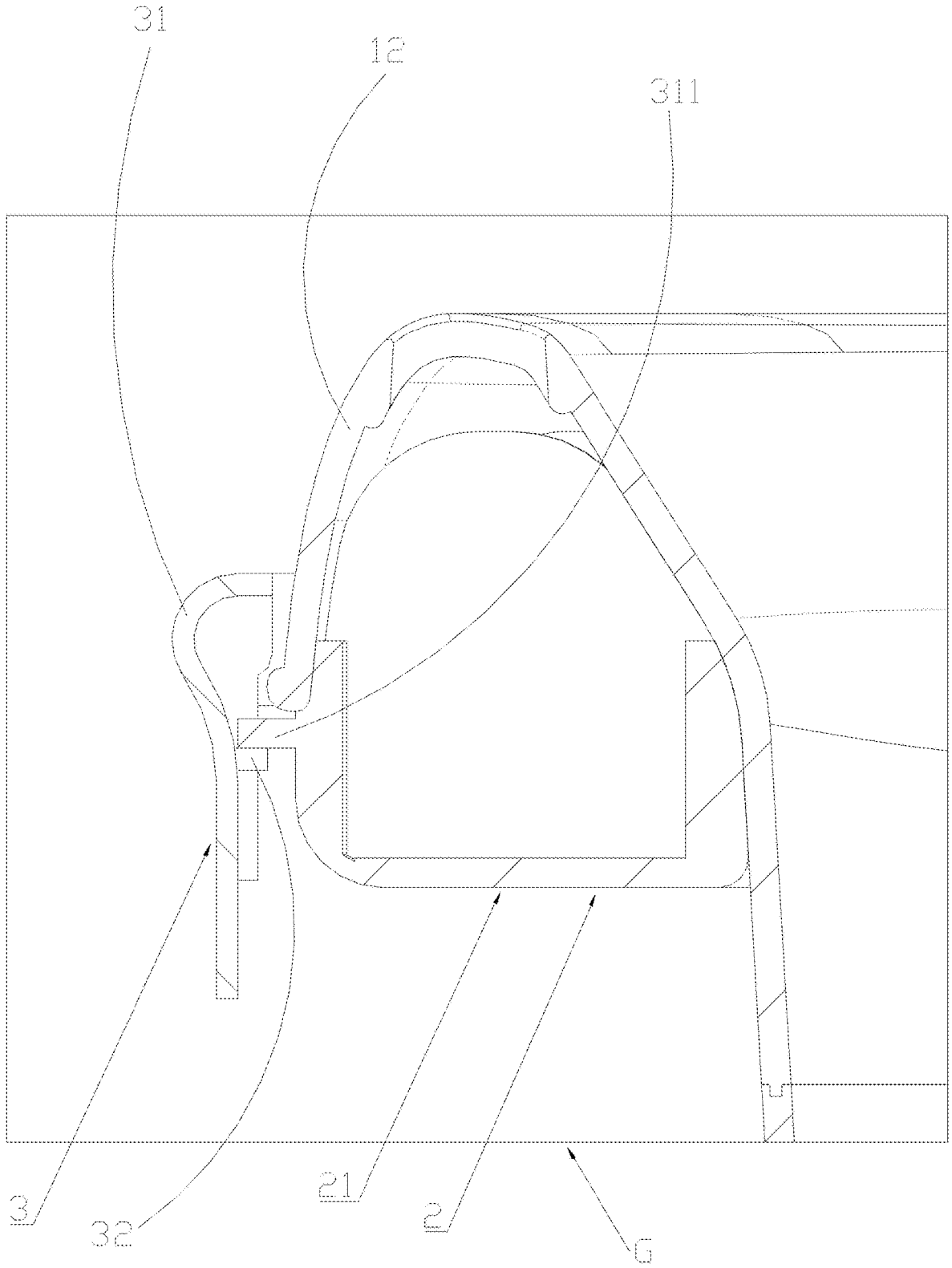
FIG. 14 an enlarged view at the position of G in FIG. 13.
Figure 15:
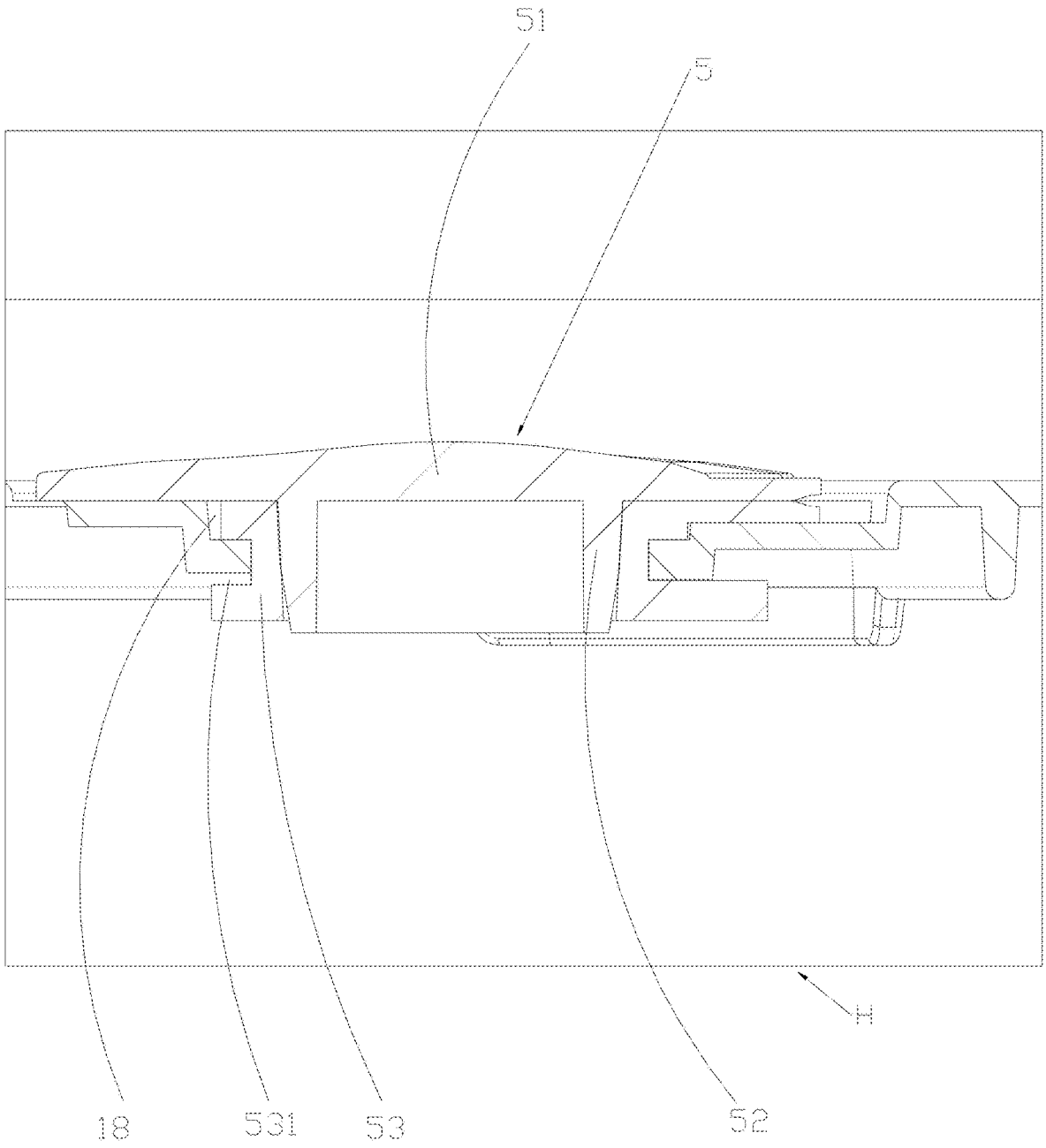
FIG. 15 is an enlarged view at the position of H in FIG. 13

Referring to FIG. 1 to FIG. 16, a folding bathtub includes:

a bathtub body 1; and a supporting body 2, wherein the supporting body 2 is provided with a support frame 21 and support legs 22, the support legs 22 are connected with the support frame 21, and the support frame 21 is supported by the support legs 22; and the support frame 21 is detachably connected with the bathtub body 1, and the bathtub body 1 is supported by the support frame 21.

Through the above-mentioned structure, the folding bathtub includes a bathtub body 1 and a supporting body. The supporting body 2 is provided with a support frame 21 and support legs 22, the support legs 22 are connected with the support frame 21, and the support frame 21 is supported by the support legs 22. The support frame 21 is detachably connected with the bathtub body 1, and the bathtub body 1 is supported by the support frame 21, so that the support frame 21 can be connected with the bathtub body 1 when the bathtub body 1 needs to be used by a user, the bathtub body 1 is supported by the support legs 22 and the support frame 21, and the bathtub body 1 is prevented from being deformed to be convenient for the user to use. When the user needs to store, package, and transport the folding bathtub, the support frame 21 and the support legs 22 can be detached from the bathtub body 1, so that the bathtub body 1, the support frame 21, and the support legs 22 can be stacked mutually so as to reduce the volume of the folding bathtub and facilitate the storage, package, and transportation of the bathtub body 1, the support frame 21, and the support legs 22.

In the embodiment, the bathtub body 1 is provided with a body part 11 and a supporting part 12 extending out on the upper side of the body part 11, the supporting part 12 is connected with the support frame 21, and the supporting part 12 is supported by the support frame 21. Wherein, a concave support ring slot 121 is formed in the supporting part 12, and the support frame 21 is arranged inside the support ring slot 121. Through the above-mentioned structure, the support frame 21 is arranged inside the support ring slot 121, so that the support frame 21 can support the bathtub body 1 more firmly and prevent the bathtub body 1 from slipping off from the support frame 21.

In the embodiment, the folding bathtub also includes a first locking device 3. The support frame 21 is detachably connected with the bathtub body 1 through the first locking device 3. Wherein, the first locking device 3 includes a locking overturning buckle 31 and a first locking portion 32. The first locking portion 32 is arranged on the support frame 31. The locking overturning buckle 31 is provided with a second locking portion 311. The locking overturning buckle 31 is rotatably connected with the bathtub body 1. The locking overturing buckle 31 can rotate between a locking position and an unlocking position. When the locking overturning buckle 31 rotates to the locking position, the second locking portion 311 is connected with the first locking portion 32, and the first locking portion 32 is compressed towards the direction of the bathtub body 1 by the second locking portion 311 so that the support frame 21 is compressed and locked to the bathtub body 1. When the locking overturning buckle 31 rotates to the unlocking position, the second locking portion 311 is separated from the first locking portion 32 so as to release the unlocking between the support frame 21 and the bathtub body 1. Wherein, the first locking portion 32 is a first locking bulge, and the second locking portion 311 is a second locking bulge. Wherein, the number of the second locking portions 311 is two, and the two second locking portions 311 are arranged at intervals mutually along the transverse direction of the locking overturning buckle 31. Specifically, the locking overturning buckle 31 is provided with a first rotating shaft 312. The bathtub body 1 is provided with two mounting lugs 13 arranged at intervals mutually. A first mounting hole 131 is formed in the mounting lug 13. The first rotating shaft 312 is plugged and mounted in the first mounting hole 131. The first rotating shaft 312 can rotate inside the first mounting hole 131. Further, the number of the second locking devices 3 is two, the two first locking devices 3 are respectively located on left and right sides of the bathtub body 1, and the support frame 21 is compressed and locked to the bathtub body 1 by the first locking device 3. Through the above-mentioned structure, the arrangement of the first locking device 3 is realized effectively, and the support frame 21 can be locked to or detached from the bathtub body 1 by overturning the locking overturning buckle 31.

In some embodiments, the first locking device 3 includes a locking overturning buckle 31 and a first locking portion 32. The first locking portion 32 is arranged on the bathtub body 1. The locking overturning buckle 31 is provided with a second locking portion 311. The locking overturning buckle 31 is rotatably connected with the support frame 21. The locking overturing buckle 31 can rotate between a locking position and an unlocking position. When the locking overturning buckle 31 rotates to the locking position, the second locking portion 311 is connected with the first locking portion 32, and the first locking portion 32 is compressed towards the direction of the bathtub body 1 by the second locking portion 311 so that the support frame 21 is compressed and locked to the bathtub body 1. When the locking overturning buckle 31 rotates to the unlocking position, the second locking portion 311 is separated from the first locking portion 32 so as to release the unlocking between the support frame 21 and the bathtub body 1. Through the above-mentioned structure, the arrangement of the first locking device 3 is realized effectively, and the support frame 21 can be locked to or detached from the bathtub body 1 by overturning the locking overturning buckle 31. Wherein, the locking overturning buckle 31 is rotatably connected with the supporting part 12.

In the embodiment, the support frame 21 includes a left support frame 211 and a right support frame 212, and the left support frame 211 is detachably connected with the right support frame 212. Wherein, the folding bathtub also includes a first connecting device 4, the left support frame 211 is detachably connected with the right support frame 212 through the first connecting device 4 so that the left support frame 21 and the right support frame 21 are connected into a whole body. Through the above-mentioned structure, the detachable connection between the left support frame 211 and the right support frame 212 is effectively realized. When the user needs to store, package, and transport the folding bathtub, the left support frame 211 and the right support frame 212 can be separated, and the left support frame 211 and the right support frame 212 can be stacked mutually so as to reduce the length of the support frame 21 and facilitate the storage, package, and transportation of the folding bathtub.

In the embodiment, the left support frame 211 is provided with a first end 2111 and a second end 2112. The right support frame 212 is provided with a third end 2121 and a fourth end 2122. The first connecting device 4 includes a first connecting piece 41 and a second connecting piece 42. The first end 2111 is detachably connected with the third end 2121 through the first connecting piece 41. The second end 2112 is detachably connected with the fourth end 2122 through the second connecting piece 42 so that the left support frame 21 and the right support frame 21 are connected into a whole body. Wherein, a first splicing groove 21111 is formed in the first end 2111. A second splicing groove 21211 is formed in the third end 2121. One end of the first connecting piece 41 is provided with a first splicing lug 411, and the other end of the first connecting piece 41 is provided with a second splicing lug 412. The first splicing lug 411 is detachably connected with the first splicing groove 21111. The second splicing lug 412 is detachably connected with the second splicing groove 21211. A third splicing groove 21121 is formed in the second end 2112. A fourth splicing groove 21221 is formed in the fourth end 2122. One end of the second connecting piece 42 is provided with a third splicing lug 421, and the other end of the second connecting piece 42 is provided with a fourth splicing lug 422. The third splicing lug 421 is detachably connected with the third splicing groove 21121. The fourth splicing lug 422 is detachably connected with the fourth splicing groove 21221 so that the left support frame 21 and the right support frame 21 are connected into a whole body. Or, the first end 211 is provided with a first splicing lug 411. The third end 2121 is provided with a second splicing lug 412. A first splicing groove 21111 is formed in one end of the first connecting piece 41, and a second splicing groove 21211 is formed in the other end of the first connecting piece 41. The first splicing lug 411 is detachably connected with the first splicing groove 21111. The second splicing lug 412 is detachably connected with the second splicing groove 21211. The second end 2112 is provided with a third splicing lug 421. The fourth end 2122 is provided with a fourth splicing lug 422. A third splicing groove 21121 is formed in one end of the second connecting piece 42, and a fourth splicing groove 21221 is formed in the other end of the second connecting piece 42. The third splicing lug 421 is detachably connected with the third splicing groove 21121. The fourth splicing lug 422 is detachably connected with the fourth splicing groove 21221 so that the left support frame 21 and the right support frame 21 are connected into a whole body. Specifically, the first splicing groove 21111, the second splicing groove 21211, the third splicing groove 21121 and the fourth splicing groove 21221 are all splicing grooves that are narrow in the front and wide in the rear, and the first splicing lug 411, the second splicing lug 412, the third splicing lug 421, and the fourth splicing lug 422 are all splicing lugs that are narrow in the front and wide in the rear. Through the above-mentioned structure, the detachable connection between the left support frame 211 and the right support frame 212 is effectively realized, and the left-and-right deviation between the left support frame 211 and the right support frame 212 can be prevented, so that the connection between the left support frame 211 and the right support frame 212 is more stable.

In the embodiment, a first plug-in mounting port 21112 is formed in an inner wall of the first splicing groove 21111. A second plug-in mounting port 21212 is formed in an inner wall of the second splicing groove 21211. A third plug-in mounting port 21122 is formed in an inner wall of the third splicing groove 21121. A fourth plug-in mounting port 21222 is formed in an inner wall of the fourth splicing groove 21221. A protruding first plug-in mounting block 4111 is extended on a side wall of the first splicing lug 411. A protruding second plug-in mounting block 4121 is extended on a side wall of the second splicing lug 412. A protruding third plug-in mounting block 4211 is extended on a side wall of the third splicing lug 421. A protruding fourth plug-in mounting block 4221 is extended on a side wall of the fourth splicing lug 422. The first plug-in mounting block 4111 is connected with the first plug-in mounting port 21112. The second plug-in mounting block 4121 is connected with the second plug-in mounting port 21212. The third plug-in mounting block 4211 is connected with the third plug-in mounting port 21122. The fourth plug-in mounting block 4221 is connected with the fourth plug-in mounting port 21222. Or, the protruding first plug-in mounting block 4111 is extended on the inner wall of the first splicing groove 21111. The protruding second plug-in mounting bloc 4121 is extended on the inner wall of the second splicing groove 21211. The protruding third plug-in mounting block 4211 is extended on the inner wall of the third splicing groove 21121. The protruding fourth plug-in mounting block 4221 is extended on the inner wall of the fourth splicing groove 21221. The first plug-in mounting port 21112 is formed in the side wall of the first splicing lug 411. The second plug-in mounting port 21212 is formed in the side wall of the second splicing lug 412. The third plug-in mounting port 21122 is formed in the side wall of the third splicing lug 421. The fourth plug-in mounting port 21222 is formed in the side wall of the fourth splicing lug 422. The first plug-in mounting block 4111 is connected with the first plug-in mounting port 21112. The second plug-in mounting block 4121 is connected with the second plug-in mounting port 21212. The third plug-in mounting block 4211 is connected with the third plug-in mounting port 21122. The fourth plug-in mounting block 4221 is connected with the fourth plug-in mounting port 21222. Wherein, the first plug-in mounting block 4111, the second plug-in mounting block 4121, the third plug-in mounting block 4211 and the fourth plug-in mounting block 4221 are all provided with a guide inclined surface 413. The first splicing lug 411 can be detached from the first splicing groove 21111 along the guide inclined surface 413. The second splicing lug 412 can be detached from the second splicing groove 21211 along the guide inclined surface 413. The third splicing lug 421 can be detached from the third splicing groove 21121 along the guide inclined surface 413. The fourth splicing lug 422 can be detached from the fourth splicing groove 21221 along the guide inclined surface 413. Through the above-mentioned structure, the first plug-in mounting block 4111 is connected with the first plug-in mounting port 21112, the second plug-in mounting block 4121 is connected with the second plug-in mounting port 21212, the third plug-in mounting block 4211 is connected with the third plug-in mounting port 21122, and the fourth plug-in mounting block 4221 is connected with the fourth plug-in mounting port 21222, so that the up-and-down deviation between the left support frame 211 and the right support frame 212 can be prevented, and the connection between the left support frame 211 and the right support frame 212 is more stable. Furthermore, the arrangement of the guide inclined surface 413 can facilitate the user to detach and separate the left support frame 211 and the right support frame 212.

In the embodiment, the support legs 22 are removably connected with the support frame 21, and the support legs 22 can move between a folding position and a supporting position. Wherein, the support frame 21 is provided with a protruding mounting part 213. The support legs 22 are rotatably connected with the mounting part 213 of the support frame 21. The support legs 22 can rotate between the folding position and the supporting position. A supporting lug 221 is extended on the side wall of the support leg 22. When the support leg 22 rotates to the supporting position, a bottom surface of the mounting part 213 is supported by the supporting lug 221. When the support leg 22 rotates to the folding position, the support leg 22 and the support frame 21 are stacked mutually. Specifically, the number of the support legs 22 is two, and the two support legs 22 are rotatably connected with both sides of the support frame 21 respectively. The support frame 21 is a ring-shaped support frame 21, and the supporting part 12 is a ring-shaped supporting part 12. Further, the support leg 22 is rotatably connected with the support frame 21 through a rotating shaft. Through the above-mentioned structure, the support leg 22 can move between the folding position and the supporting position. When the user needs to use the folding bathtub, the support leg 22 can rotate to the supporting position to support the support frame 21, so that the folding bathtub is supported by the support frame 21 and the support feet 22, and the folding bathtub is prevented from being deformed to be convenient for the user to use. When the user needs to store, transport and package the folding bathtub, the support leg can rotate to the folding position, so that the support leg and the support frame are stacked mutually so as to reduce the volume occupied by the support leg and the support frame. And, the bottom surface of the mounting part 213 is supported by the supporting lug 221 when the support leg 22 rotates to the supporting position, and a part of the weight of the folding bathtub and the support frame 21 can be shared to the supporting lug 221, so the total weight of the folding bathtub and the support frame 21 is prevented from being concentrated on the rotating shaft. Further, the bottom surface of the mounting part 213 is supported by the supporting lug 221 when the support leg 22 rotates to the supporting position, and the supporting lug 221 can make close contact with the bottom surface of the mounting part 213 through the dead weight of the folding bathtub and the support frame 21, so the support leg 22 is prevented from being deviated.

In the embodiment, the bathtub body 1 includes an upper side wall part 14, a bottom part 15 and a middle connecting wall part 16 for connecting the upper side wall part 14 and the bottom part 15, and the upper side wall part 14, the bottom part 15 and the middle connecting wall part 16 are surrounded to form a first accommodating cavity for accommodating liquid. The upper side wall part 14 includes a first left side part 141 and a first right side part 142. The middle connecting wall part 16 includes a middle side wall part 161. The upper side of the middle side wall part 16 is convexly provided with an upper connecting part 162. The upper connecting part 162 is located between the first left side part 141 and the first right side part 142. The upper connecting part 162 is used for connecting the first left side part 141 and the first right side part 142. A bottom connecting part 163 is extended on the lower side of the middle side wall part 161. The bottom part 15 includes a first bottom 151 and a second bottom 152. The bottom connecting part 163 is located between the first bottom 151 and the second bottom 152. The bottom connecting part 163 is used for connecting the first bottom 151 and the second bottom 152. The bottom connecting part 163 is a flexible bottom connecting part 163 so as to be foldable between the first bottom 151 and the second bottom 152. The upper connecting part 162 is a flexible upper connecting part 162 so as to be foldable between the first left side part 141 and the first right side part 142. The middle side wall part 161 is a flexible middle side wall part 161 so as to be foldable between the upper side wall part 14 and the bottom part 15. Wherein, the middle connecting wall part 16 is a flexible silicone middle connecting wall part 16, the upper side wall part 14 is a rigid upper side wall part 14, and the bottom wall part 15 is a rigid bottom wall part 15. Through the above-mentioned structure, the bottom connecting part 163 is a flexible bottom connecting part 163 so as to be foldable between the first bottom 151 and the second bottom 152. The upper connecting part 162 is a flexible upper connecting part 162 so as to be foldable between the first left side part 141 and the first right side part 142. The middle side wall part 161 is a flexible middle side wall part 161 so as to be foldable between the upper side wall part 14 and the bottom wall part 15. The volume of the folding bathtub can be further reduced by folding to facilitate storage, package and transportation of the folding bathtub. Wherein, the upper connecting part 162, the bottom connecting part 163 and the middle side wall part 161 are integrally formed.

In the embodiment, the folding bathtub also includes a sealing plug 5. A water outlet 18 is formed in the bottom of the bathtub body 1, and the water outlet 18 is detachably covered with the sealing plug 5. The sealing plug 5 is provided with a covering part 51. A plug-in mounting part 52 extending out of the covering part 51 and a stop ring 53. The water outlet 18 is covered with the covering part 51. The plug-in mounting part 52 is plugged in and mounted inside the water outlet 18. The plug-in mounting part 52 penetrates into a lower surface of the bottom of the bathtub body 1 through the water outlet 18 from an upper surface of the bottom of the bathtub body 1. The stop ring 53 detachably sleeves the plug-in mounting part 52. The stop ring 53 is used for stopping the covering part 51 and the plug-in mounting part 52 inside the water outlet 18. Through the above-mentioned structure, the arrangement of the water outlet 18 can facilitate the user to pour out liquid in the bathtub. And when the user needs to use the folding bathtub to hold the liquid, a shell seals the water outlet 18 through the sealing plug 5 to prevent the liquid from overflowing through the water outlet 18. Wherein, a sealing groove 531 is formed in the side wall of the stop ring, and the edge of the water outlet is embedded in the sealing groove.

In the embodiment, hollowed-out grooves 23 are formed in the support frame 21 and the support legs 22, and the hollowed-out groove 23 is internally provided with a plurality of reinforcing ribs 24. The support leg 22 includes a bottom supporting portion 26 and two side supporting portions 27, the two side supporting portions 27 are connected to both ends of the bottom supporting portion 26 respectively, and the side supporting portion 27 is connected with the support frame 21. Through the above-mentioned structure, the hollowed-out groove 23 can reduce the dead weight of the support frame 21 and the support leg 22 to facilitate the transportation of the support frame 21 and the support leg 22. Furthermore, the design of the hollowed-out groove 23 can save materials for forming the support frame 21 and the support leg 22, and the environment is protected.

In the embodiment, a protruding first support ring 1511 is extended on the bottom surface of the first bottom, a protruding second support ring 1521 is extended on the bottom surface of the second bottom, and a protruding third support ring 1631 is extended on the bottom surface of the bottom connecting part 163. The number of the third support rings is two to eight, and the two to weight third support rings 1631 are arranged at intervals mutually along the bottom surface of the bottom connecting part 163. The water outlet is formed in the second bottom, and the water outlet is located inside the second support ring 1521. Both the first support ring 1511 and the second support ring 1521 are square in shapes, and the third support rings 1631 are all circular. Wherein, a plurality of sheet-shaped supporting bulges 25 are extended on the upper side of the support frame, and the supporting bulges 25 are arranged at intervals mutually along the upper side of the support frame. Through the above-mentioned structure, the first support ring, the second support ring and the third support ring can reinforce the support strength of the first bottom, the second bottom and the third bottom.

Figure 16:
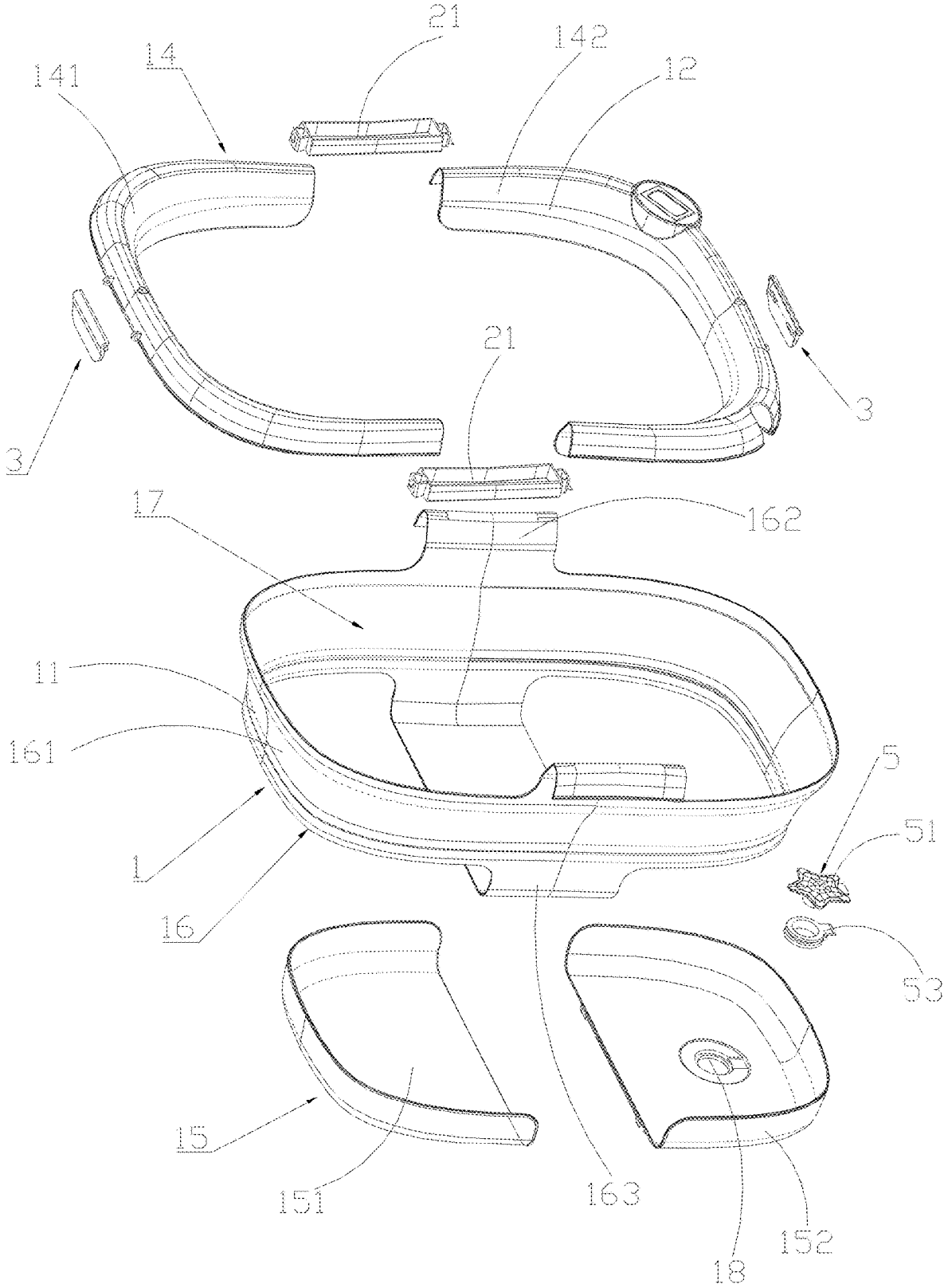
FIG. 16 is another integral structural schematic diagram of the present invention.

Referring to FIG. 16, a folding bathtub includes:

a bathtub body 1; and a supporting body 2, wherein the supporting body 2 is provided with a support frame 21 and support legs 22, and the support legs 22 and the support frame 21 are configured to support the bathtub body 1; the support legs 22 are connected with the bathtub body 1, and two sides of the bathtub body 1 are supported by the support legs 22; the support frame 21 is detachably connected with the bathtub body 1, and a middle of the bathtub body 1 is supported by the support frame 21. Specifically, the bathtub body 1 includes an upper side wall part 14, a bottom part 15 and a middle connecting wall part 16 for connecting the upper side wall part 14 and the bottom part 15, and the upper side wall part 14, the bottom part 15 and the middle connecting wall part 16 are surrounded to form a first accommodating cavity 17 for accommodating liquid; the upper side wall part 14 includes a first left side part 141 and a first right side part 142; the middle connecting wall part 16 includes a middle side wall part 161, an upper side of the middle side wall part 161 is convexly provided with an upper connecting part 162, the upper connecting part 162 is located between the first left side part 141 and the first right side part 142, and the upper connecting part 162 is configured to connect the first left side part 141 and the first right side part 142; a bottom connecting part 163 is extended from the lower side of the middle side wall part 161, the bottom part 15 includes a first bottom 151 and a second bottom 152, the bottom connecting part 163 is located between the first bottom 151 and the second bottom 152, and the bottom connecting part 163 is configured to connect the first bottom 151 and the second bottom 152; the bottom connecting part 163 is a flexible bottom connecting part 163 so as to be foldable between the first bottom 151 and the second bottom 152, the upper connecting part 162 is a flexible upper connecting part 162 so as to be foldable between the first left side part 141 and the first right side part 142, and the middle side wall part 161 is a flexible middle side wall part 161 so as to be foldable between the upper side wall part 14 and the bottom part 15. The support legs 22 support the first left side part 141 and/or the first right side part 142 of the bathtub body 1, and the support frame 21 supports the upper connecting part 162 of the middle side wall part 161.

As described above, one or more embodiments are provided in conjunction with the detailed description. The specific implementation of the present invention is not confirmed to be limited to that the description is similar to or similar to the method, the structure and the like of the present invention, or a plurality of technical deductions or substitutions are made on the premise of the conception of the present invention to be regarded as the protection of the present invention.

What is claimed is:

1. A folding bathtub, comprising:

a bathtub body (1);

A supporting body (2), wherein the supporting body (2) is provided with a support frame (21) and support legs (22), and the support legs (22) and the support frame (21) are configured to support the bathtub body (1); the support frame (21) is detachably connected with the bathtub body (1), and the bathtub body (1) is supported by the support frame (21); further comprising a first locking device (3), the support frame (21) is detachably connected with the bathtub body (1) through the first locking device (3).

2. The folding bathtub according to claim 1, wherein the support legs (22) are connected with the support frame (21), and the support frame (21) is supported by the support legs (22); the support frame (21) is detachably connected with the bathtub body (1), and the bathtub body (1) is supported by the support frame (21).

3. The folding bathtub according to claim 2, wherein the bathtub body (1) is provided with a body part (11) and a supporting part (12) extending from an upper side of the body part (11), the supporting part (12) is connected with the support frame (21), and the supporting part (12) is supported by the support frame (21).

4. The folding bathtub according to claim 3, wherein the supporting part (12) is provided with a concave support ring slot (121), and the support frame (21) is arranged within the support ring slot (121).

5. The folding bathtub according to claim 3, wherein the number of the support legs (22) is two, and the two support legs (22) are rotatably connected with both sides of the support frame (21) respectively; the support frame (21) is a ring-shaped support frame (21), and the supporting part (12) is a ring-shaped supporting part (12).

6. The folding bathtub according to claim 2, wherein the first locking device (3) comprises a locking overturning buckle (31) and a first locking portion (32), the first locking portion (32) is arranged on the support frame (21), the locking overturning buckle (31) is provided with a second locking portion (311), the locking overturning buckle (31) is rotatably connected with the bathtub body (1), the locking overturning buckle (31) is rotatable between a locking position and an unlocking position, when the locking overturning buckle (31) rotates to the locking position, the second locking portion (311) is connected with the first locking portion (32), and the first locking portion (32) is compressed towards a direction of the bathtub body (1) by the second locking portion (311) so that the support frame (21) is compressed and locked to the bathtub body (1), and when the locking overturning buckle (31) rotates to the unlocking position, the second locking portion (311) is separated from the first locking portion (32) so as to release the lock between the support frame (21) and the bathtub body (1).

7. The folding bathtub according to claim 6, wherein the first locking device (3) comprises a locking overturning buckle (31) and a first locking portion (32), the first locking portion (32) is arranged on the bathtub body (1), the locking overturning buckle (31) is provided with a second locking portion (311), the locking overturning buckle (31) is rotatably connected with the support frame (21), the locking overturning buckle (31) is rotatable between a locking position and an unlocking position, when the locking overturning buckle (31) rotates to the locking position, the second locking portion (311) is connected with the first locking portion (32), and the first locking portion (32) is compressed towards the direction of the bathtub body (1) by the second locking portion (311) so that the support frame (21) is compressed and locked to the bathtub body (1), and when the locking overturning buckle (31) rotates to the unlocking position, the second locking portion (311) is separated from the first locking portion (32) so as to release the lock between the support frame (21) and the bathtub body (1).

8. The folding bathtub according to claim 7, wherein the first locking portion (32) is a first locking bulge, and the second locking portion (311) is a second locking bulge.

9. The folding bathtub according to claim 7, wherein the locking overturning buckle (31) is provided with a first rotating shaft (312), the bathtub body (1) is provided with two mounting lugs (13) arranged at intervals mutually, a first mounting hole (131) is formed in the mounting lug (13), the first rotating shaft (312) is plugged in the first mounting hole (131), and the first rotating shaft (312) is rotatable within the first mounting hole (131); the number of the second locking portions (311) is two, and the two second locking portions (311) are arranged at intervals mutually along a transverse direction of the locking overturning buckle (31).

10. The folding bathtub according to claim 1, wherein the number of the first locking devices (3) is two, and the support frame (21) is compressed and locked to the bathtub body (1) by the two first locking devices (3).

11. The folding bathtub according to claim 1, further comprising a sealing plug (5), wherein a water outlet (18) is formed in a bottom of the bathtub body (1), and the water outlet (18) is detachably covered with the sealing plug (5); the sealing plug (5) is provided with a covering part (51), a plug-in mounting part (52) extending from the covering part (51), and a stop ring (53); the covering part (51) covers the water outlet (18), the plug-in mounting part (52) is plugged in the water outlet (18), the plug-in mounting part (52) penetrates into a lower surface of the bottom of the bathtub body (1) through the water outlet (18) from an upper surface of the bottom of the bathtub body (1), the stop ring (53) is detachably sleeved on the plug-in mounting part (52), and the stop ring (53) is configured to stop the covering part (51) and the plug-in mounting part (52) within the water outlet (18).

12. The folding bathtub according to claim 1, wherein the support frame (21) comprises a left support frame (211) and a right support frame (212), and the left support frame (211) is detachably connected with the right support frame (212); further comprising a first connecting device (4), the left support frame (211) is detachably connected with the right support frame (212) through the first connecting device (4) so that the left support frame (21) and the right support frame (21) are connected into a whole body; the left support frame (211) is provided with a first end (2111) and a second end (2112), the right support frame (212) is provided with a third end (2121) and a fourth end (2122), the first connecting device (4) comprises a first connecting piece (41) and a second connecting piece (42), the first end (2111) is detachably connected with the third end (2121) through the first connecting piece (41), and the second end (2112) is detachably connected with the fourth end (2122) through the second connecting piece (42) so that the left support frame (21) and the right support frame (21) are connected into a whole body; a first splicing groove (21111) is formed in the first end (2111), a second splicing groove (21211) is formed in the third end (2121), one end of the first connecting piece (41) is provided with a first splicing lug (411), the other end of the first connecting piece (41) is provided with a second splicing lug (412), the first splicing lug (411) is detachably connected with the first splicing groove (21111), and the second splicing lug (412) is detachably connected with the second splicing groove (21211); a third splicing groove (21121) is formed in the second end (2112), a fourth splicing groove (21221) is formed in the fourth end (2122), one end of the second connecting piece (42) is provided with a third splicing lug (421), the other end of the second connecting piece (42) is provided with a fourth splicing lug (422), the third splicing lug (421) is detachably connected with the third splicing groove (21121), and the fourth splicing lug (422) is detachably connected with the fourth splicing groove (21221) so that the left support frame (21) and the right support frame (21) are connected into a whole body; or, the first end (2111) is provided with a first splicing lug (411), the third end (2121) is provided with a second splicing lug (412), a first splicing groove (21111) is formed in one end of the first connecting piece (41), a second splicing groove (21211) is formed in the other end of the first connecting piece (41), the first splicing lug (411) is detachably connected with the first splicing groove (21111), and the second splicing lug (412) is detachably connected with the second splicing groove (21211); the second end (2112) is provided with a third splicing lug (421), the fourth end (2122) is provided with a fourth splicing lug (422), a third splicing groove (21121) is formed in one end of the second connecting piece (42), a fourth splicing groove (21221) is formed in the other end of the second connecting piece (42), the third splicing lug (421) is detachably connected with the third splicing groove (21121), and the fourth splicing lug (422) is detachably connected with the fourth splicing groove (21221) so that the left support frame (21) and the right support frame (21) are connected into a whole body.

13. The folding bathtub according to claim 12, wherein a first plug-in mounting port (21112) is formed in an inner wall of the first splicing groove (21111), a second plug-in mounting port (21212) is formed in an inner wall of the second splicing groove (21211), a third plug-in mounting port (21122) is formed in an inner wall of the third splicing groove (21121), a fourth plug-in mounting port (21222) is formed in an inner wall of the fourth splicing groove (21221), a protruding first plug-in mounting block (4111) is extended on a side wall of the first splicing lug (411), a protruding second plug-in mounting block (4121) is extended on a side wall of the second splicing lug (412), a protruding third plug-in mounting block (4211) is extended on a side wall of the third splicing lug (421), a protruding fourth plug-in mounting block (4221) is extended on a side wall of the fourth splicing lug (422), the first plug-in mounting block (4111) is connected with the first plug-in mounting port (21112), the second plug-in mounting block (4121) is connected with the second plug-in mounting port (21212), the third plug-in mounting block (4211) is connected with the third plug-in mounting port (21122), and the fourth plug-in mounting block (4221) is connected with the fourth plug-in mounting port (21222); or, the protruding first plug-in mounting block (4111) is extended on the inner wall of the first splicing groove (21111), the protruding second plug-in mounting bloc (4121) is extended on the inner wall of the second splicing groove (21211), the protruding third plug-in mounting block (4211) is extended on the inner wall of the third splicing groove (21121), the protruding fourth plug-in mounting block (4221) is extended on the inner wall of the fourth splicing groove (21221), the first plug-in mounting port (21112) is formed in the side wall of the first splicing lug (411), the second plug-in mounting port (21212) is formed in the side wall of the second splicing lug (412), the third plug-in mounting port (21122) is formed in the side wall of the third splicing lug (421), the fourth plug-in mounting port (21222) is formed in the side wall of the fourth splicing lug (422), the first plug-in mounting block (4111) is connected with the first plug-in mounting port (21112), the second plug-in mounting block (4121) is connected with the second plug-in mounting port (21212), the third plug-in mounting block (4211) is connected with the third plug-in mounting port (21122), and the fourth plug-in mounting block (4221) is connected with the fourth plug-in mounting port (21222).

14. A folding bathtub, comprising:

a bathtub body (1);

a supporting part (2), wherein the supporting body (2) is provided with support legs (22) and a mounting part (213); the mounting part (213) is connected with the bathtub body (1); the support legs (22) are configured to support the bathtub body (1); the support legs (22) are moveably connected with the mounting part (213), and the support legs (22) are moveable between a folding position and a supporting position; supporting lugs (221) are extended from side walls of the support legs (22), when the support legs (22) rotate to the supporting position, a bottom surface of the mounting part (213) is supported by the supporting lugs (221), when the support legs (22) rotate to the folding position, the support legs (22) and the bathtub body (1) are stacked mutually.

15. The folding bathtub according to claim 14, wherein the supporting body (2) is provided with a support frame (21), the support frame (21) is provided with the protruding mounting part (213), the support legs (22) are rotatably connected with the mounting part (213) of the support frame (21), the support legs (22) are rotatable between the folding position and the supporting position, the supporting lugs (221) are extended from side walls of the support legs (22), when the support legs (22) rotate to the supporting position, the bottom surface of the mounting part (213) is supported by the supporting lugs (221), when the support legs (22) rotate to the folding position, the support legs (22) and the support frame (21) are stacked mutually.

16. The folding bathtub according to claim 14, wherein the bathtub body (1) comprises an upper side wall part (14), a bottom part (15) and a middle connecting wall part (16) for connecting the upper side wall part (14) and the bottom part (15), and the upper side wall part (14), the bottom part (15) and the middle connecting wall part (16) are surrounded to form a first accommodating cavity (17) for accommodating liquid; the upper side wall part (14) comprises a first left side part (141) and a first right side part (142); the middle connecting wall part (16) comprises a middle side wall part (161), an upper side of the middle side wall part (161) is convexly provided with an upper connecting part (162), the upper connecting part (162) is located between the first left side part (141) and the first right side part (142), and the upper connecting part (162) is configured to connect the first left side part (141) and the first right side part (142); a bottom connecting part (163) is extended from the lower side of the middle side wall part (161), the bottom part (15) comprises a first bottom (151) and a second bottom (152), the bottom connecting part (163) is located between the first bottom (151) and the second bottom (152), and the bottom connecting part (163) is configured to connect the first bottom (151) and the second bottom (152); the bottom connecting part (163) is a flexible bottom connecting part (163) so as to be foldable between the first bottom (151) and the second bottom (152), the upper connecting part (162) is a flexible upper connecting part (162) so as to be foldable between the first left side part (141) and the first right side part (142), and the middle side wall part (161) is a flexible middle side wall part (161) so as to be foldable between the upper side wall part (14) and the bottom part (15).

17. The folding bathtub according to claim 16, further comprising a supporting body (2), wherein the supporting body (2) is provided with a support frame (21) and support legs (22), and the support legs (22) and the support frame (21) are configured to support the bathtub body (1); the support legs (22) are connected with the bathtub body (1), and two sides of the bathtub body (1) are supported by the support legs (22); the support frame (21) is detachably connected with the bathtub body (1), and a middle of the bathtub body (1) is supported by the support frame (21).

18. The folding bathtub according to claim 17, wherein the support legs (22) support the first left side part (141) and/or the first right side part (142) of the bathtub body (1), and the support frame (21) supports the upper connecting part (162) of the middle side wall part (161).

19. A folding bathtub, comprising:

a bathtub body (1);

A supporting body (2), wherein the supporting body (2) is connected with the bathtub body (1), the supporting body (2) is configured to support the bathtub body (1); the supporting body (2) is provided with a hollowed-out groove (23), and the hollowed-out groove (23) is internally provided with a plurality of reinforcing ribs (24); the supporting body (2) comprises support legs (22), the support legs (22) comprise a bottom supporting portion (26) and two side supporting portions (27), the two side supporting portions (27) are connected to both ends of the bottom supporting portion (26) respectively, and the side supporting portion (27) is connected with the support frame (21).

20. The folding bathtub according to claim 19, wherein hollowed-out grooves (23) are formed in the support frame (21) and the support legs (22), and the hollowed-out groove (23) is internally provided with a plurality of reinforcing ribs (24); the support legs (22) comprise a bottom supporting portion (26) and two side supporting portions (27), the two side supporting portions (27) are connected to both ends of the bottom supporting portion (26) respectively, and the side supporting portion (27) is connected with the support frame (21).

* * * * *